US007925500B2

(12) United States Patent
Endo et al.

(10) Patent No.: US 7,925,500 B2
(45) Date of Patent: Apr. 12, 2011

(54) PITCH CONVERSION METHOD AND DEVICE FOR CONVERTING A PITCH OF AN INPUT SIGNAL INTO A DESIRED PITCH

(75) Inventors: Kaori Endo, Kawasaki (JP); Chikako Matsumoto, Kawasaki (JP); Taro Togawa, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 994 days.

(21) Appl. No.: 11/802,228

(22) Filed: May 21, 2007

(65) Prior Publication Data

US 2008/0091417 A1 Apr. 17, 2008

(30) Foreign Application Priority Data

Jul. 20, 2006 (JP) ..... 2006-198560

(51) Int. Cl.
*G10L 11/04* (2006.01)

(52) U.S. Cl. ..... 704/207

(58) Field of Classification Search ..... 704/207
See application file for complete search history.

(56) References Cited

U.S. PATENT DOCUMENTS

2003/0158728 A1 8/2003 Bi et al.

FOREIGN PATENT DOCUMENTS

| | | |
|---|---|---|
| JP | 2-66600 | 3/1990 |
| JP | 7-219597 | 8/1995 |
| JP | 10-78791 | 3/1998 |

OTHER PUBLICATIONS

Extended European Search issued in corresponding European Patent Application No. 07108659.9, on Aug. 3, 2007.

Xuejing SUN, "Voice Quality Conversion in TD-PSOLA Speech Synthesis", IEEE, vol. 2, Jun. 5, 2000, pp. 953-956.

*Primary Examiner* — Susan McFadden
(74) *Attorney, Agent, or Firm* — Staas & Halsey LLP

(57) ABSTRACT

In a pitch conversion method and device which can reduce data throughput while suppressing a degradation of sound quality due to a pitch conversion as much as possible, an input signal pitch pattern per predetermined processing unit and a target pitch pattern are inputted, and a degradation degree indicating how a waveform of the input signal degrades upon pitch conversion from the input signal pitch pattern to the target pitch pattern is calculated. Alternatively, a degradation degree corresponding to a voice state and a phonemic type of the input signal is extracted from a database in which all of combinations of voice states and phonemic types estimated are associated with the degradation degrees to be recorded. Then, a pitch converter which performs a pitch conversion with small data throughput and a pitch converter which performs a pitch conversion with large data throughput are switched over depending on the degradation degree.

16 Claims, 24 Drawing Sheets

| INPUT SIGNAL PITCH PATTERN CHANGING TREND TND_I | TARGET PITCH PATTERN CHANGING TREND TND_T | | | | | | | | |
|---|---|---|---|---|---|---|---|---|---|
| | TND 1 | TND 2 | TND 3 | TND 4 | TND 5 | TND 6 | TND 7 | TND 8 | TND 9 |
| TND 1 | 0 | 1 | 2 | 1 | 2 | 3 | 2 | 3 | 4 |
| TND 2 | 1 | 0 | 1 | 2 | 1 | 2 | 3 | 2 | 3 |
| TND 3 | 2 | 1 | 0 | 3 | 2 | 1 | 4 | 3 | 2 |
| TND 4 | 1 | 2 | 3 | 0 | 1 | 2 | 1 | 2 | 3 |
| TND 5 | 2 | 1 | 2 | 1 | 0 | 1 | 2 | 1 | 2 |
| TND 6 | 3 | 2 | 1 | 2 | 1 | 0 | 3 | 2 | 1 |
| TND 7 | 2 | 3 | 4 | 1 | 2 | 3 | 0 | 1 | 2 |
| TND 8 | 3 | 2 | 3 | 2 | 1 | 2 | 1 | 0 | 1 |
| TND 9 | 4 | 3 | 2 | 3 | 2 | 1 | 2 | 1 | 0 |

( 0~4: PITCH PATTERN CHANGE DEGREE CHG)

| ADDITIONAL INFORMATION INFO | DEGRADATION DEGREE DGR |
|---|---|
| VOICE STATE="TRANSITION", PHONEMIC TYPE="O" | 10 |
| VOICE STATE="TRANSITION", PHONEMIC TYPE ="m" | 3 |
| ... | ... |
| VOICE STATE="START-UP", PHONEMIC TYPE ="A" | 5 |

PITCH CONVERSION METHOD AND DEVICE FOR CONVERTING A PITCH OF AN INPUT SIGNAL INTO A DESIRED PITCH

CROSS REFERENCE TO RELATED APPLICATIONS

This application is based on and claims priority to Japanese Application No. 2006-198560, filed on Jul. 20, 2006, the disclosure of which is hereby incorporated herein by reference.

BACKGROUND OF THE INVENTION

1. Field of the Invention

The present invention relates to a pitch conversion method and device, and in particular to a pitch conversion method and device for converting a pitch of an input signal into a desired (target) pitch in order to change e.g. a voice level or accent.

2. Description of the Related Art

Prior art examples [1] and [2] of the above-mentioned pitch conversion technology will now be described referring to FIG. 24.

Prior Art Example [1] (PSOLA method): FIG. 24

In this pitch conversion technology, a pitch conversion is performed by overlapping and adding waveforms of an input signal per pitch cycle in conformity with a target pitch (namely, the input signal is eventually expanded or contracted in the direction of time axis), and is generally called a PSOLA (Pitch-Synchronous Overlap and Add) method (see e.g. patent document 1).

FIG. 24 shows an example of the pitch conversion for contracting an input signal "In" in the direction of time axis by using the PSOLA method.

Namely, two waveforms W1 and W2 are firstly cut from the input signal "In" per pitch cycle T, and then window functions F1 and F2 are respectively applied to the cut waveforms W1 and W2 to adjust the amplitudes. In order to avoid discontinuity of waveforms at the boundary between an overlapped portion of the waveforms W1 and W2 by overlapping and adding which will be described later and the non-overlapped portion, the window functions F1 and F2 are set so that the sum of mutual contribution degrees may become "1" at the overlapped portion of the waveforms W1 and W2 as shown in FIG. 24.

Then, two waveforms (not shown) whose amplitudes are adjusted by the window functions F1 and F2 are overlapped and added to obtain the output signal "Out".

In such a prior art example [1], waveforms after the pitch conversion may be deformed since waveforms whose phases are different from each other are overlapped. This deformation is notable especially when a pitch conversion ratio (namely, an expansion and contraction ratio of the input signal in the direction of time axis) is large, which leads to a degradation of sound quality.

In order to deal with this problem, a prior art example [2] has been already proposed as described herebelow:

Prior Art Example [2]: Not shown

In this pitch conversion technology, a linear predictive analysis is firstly performed to the input signal, so that the signal is separated into an envelope signal (formant component) and a residual signal (harmonics component). Then, a pitch conversion is performed only to the residual signal in the same way as the above-mentioned prior art example [1], so that the residual signal after the pitch conversion has been performed and the original envelope signal are synthesized by using a linear predictive coefficient calculated from the input signal.

Thus, the pitch conversion can be performed without affecting the envelope signal, and the above-mentioned waveform deformation due to the pitch conversion can be reduced, so that a degradation of sound quality can be avoided (see e.g. patent document 2).

[Patent document 1] Japanese Patent Application Laid-open No. 10-78791

[Patent document 2] Japanese Patent Application Laid-open No. 7-219597

While in the above-mentioned prior art example [2] the pitch conversion can be performed without deteriorating the sound quality of the input signal compared with the above-mentioned prior art example [1], there is a problem that the linear predictive analysis and the signal separation/synthesis require processing of large data throughput (calculation amount or the like).

SUMMARY OF THE INVENTION

It is accordingly an object of the present invention to provide a pitch conversion method and device which can reduce data throughput while suppressing a degradation of sound quality due to a pitch conversion as much as possible.

[1] In order to achieve the above-mentioned object, a pitch conversion method (or device) according to one aspect of the present invention comprises: a degradation evaluation step of (or means) inputting an input signal pitch pattern per predetermined processing unit and a target pitch pattern for the input signal pitch pattern, and of calculating a degradation degree indicating how a waveform of the input signal degrades upon pitch conversion from the input signal pitch pattern to the target pitch pattern; and a pitch conversion step of (or means) performing the pitch conversion with predetermined data throughput depending on the degradation degree.

Namely, at a degradation evaluation step (or means), a degradation degree is calculated in advance of the execution of a pitch conversion, and at a pitch conversion step (or means), data throughput for performing the pitch conversion is switched over depending on the degradation degree.

Thus, when the degradation degree is small, the pitch conversion can be performed with small data throughput by using the pitch conversion technology shown in e.g. the above-mentioned prior art example [1] since a degradation of sound quality due to the pitch conversion does not occur. Also, only when a high-performance pitch conversion is required to be performed due to a large degradation degree, the pitch conversion can be performed by using the pitch conversion technology shown in e.g. the above-mentioned prior art example [2]. Therefore, it is possible to reduce a processing load (i.e. the entire data throughput).

[2] Also, in the above-mentioned [1], the degradation evaluation step (or means) may include an average pitch conversion amount calculation step of (or means) calculating an average pitch conversion amount by dividing a sum of pitch differences between the target pitch pattern and the input signal pitch pattern per predetermined cycle by a sum of pitches of the input signal pitch pattern per predetermined cycle, and a degradation degree calculation step of (or means) providing as the degradation degree to the pitch conversion step (or means) a value that is the average pitch conversion amount weighted by predetermined coefficients.

Namely, since this average pitch conversion amount is a value indicating how much pitch conversion is required to be performed for an input signal per predetermined processing unit (namely, how a waveform of an input signal can be deformed), the value can be used as the degradation degree.

[3] Also, in the above-mentioned [1], the pitch conversion step (or means) may include a first and second pitch conversion steps (or means) depending on a level of the degradation degree, accordingly the degradation evaluation step (or means) may also include the identical first and second pitch conversion steps (or means), and the degradation evaluation step (or means) may further include an average signal difference calculation step of (or means) calculating an average signal difference by dividing a sum of power differences between a first pitch conversion result obtained by converting a part of the input signal pitch pattern per predetermined processing unit and the target pitch pattern at the first pitch conversion step (or means) and a second pitch conversion result obtained by converting a part of the input signal pitch pattern per predetermined processing unit and the target pitch pattern at the second pitch conversion step (or means) per predetermined cycle by a sum of powers of the second pitch conversion result per predetermined cycle, and a degradation degree calculation step of (or means) providing as the degradation degree to the pitch conversion step (or means) a value that is the average signal difference weighted by predetermined coefficients.

Namely, the degradation evaluation step (or means) performs the pitch conversion to the part of the input signal pitch pattern per predetermined processing unit and the target pitch pattern in advance of the execution of the pitch conversion at a subsequent pitch conversion step (or means) respectively at the first pitch conversion step (or means) and the second pitch conversion step (or means) which are the same as the pitch conversion step (or means) included at the subsequent stage.

An average signal difference obtained based on the results of both pitch conversions mentioned above is a value indicating a difference closer to a difference between the results of the pitch conversions as respectively and actually performed at the first pitch conversion step (or means) and the second pitch conversion step (or means) included in the pitch conversion step (or means). When the average signal difference is small, it can be regarded that there is no difference between the pitch conversion results regardless of the size of data throughput (namely, the degradation of sound quality due to the pitch conversion does not occur regardless of the size of the data throughput). Therefore, the average signal difference can be used as the degradation degree.

[4] Also, in the above-mentioned [1], the degradation evaluation step (or means) may include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and of determining a pitch pattern change degree to the target pitch pattern for the input signal pitch pattern based on a combination of both changing trends, and a degradation degree calculation step of (or means) providing as the degradation degree to the pitch conversion step (or means) a value that is the pitch pattern change degree weighted by predetermined coefficients.

Namely, since this pitch pattern change degree is a value obtained from a correlation between the change trend of the input signal pitch pattern and that of the target pitch pattern (namely, e.g. a value indicating whether or not the pitch of the input signal is required to be greatly changed), the value can be used as the degradation degree.

[5] Also, in the above-mentioned [2], the pitch conversion step (or means) may include a first and second pitch conversion steps (or means) depending on a level of the degradation degree, accordingly the degradation evaluation step (or means) may also include the identical first and second pitch conversion steps (or means), and the degradation evaluation step (or means) may further include an average signal difference calculation step of (or means) calculating an average signal difference by dividing a sum of power differences between a first pitch conversion result obtained by converting a part of the input signal pitch pattern per predetermined processing unit and the target pitch pattern at the first pitch conversion step (or means) and a second pitch conversion result obtained by converting a part of the input signal pitch pattern per predetermined processing unit and the target pitch pattern at the second pitch conversion step (or means) per predetermined cycle by a sum of powers of the second pitch conversion result per predetermined cycle, and the degradation degree calculation step (or means) may provide as the degradation degree to the pitch conversion step (or means) a sum of values that are the average pitch conversion amount and the average signal difference respectively weighted by predetermined coefficients.

[6] Also, in the above-mentioned [2], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and of determining a pitch pattern change degree to the target pitch pattern for the input signal pitch pattern based on a combination of both changing trends, and the degradation degree calculation step (or means) may provide as the degradation degree to the pitch conversion step (or means) a sum of values that are the average pitch conversion amount and the pitch pattern change degree respectively weighted by predetermined coefficients.

[7] Also, in the above-mentioned [3], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and of determining a pitch pattern change degree to the target pitch pattern for the input signal pitch pattern based on a combination of both changing trends, and the degradation degree calculation step (or means) may provide as the degradation degree to the pitch conversion step (or means) a sum of values that are the average signal difference and the pitch pattern change degree respectively weighted by predetermined coefficients.

[8] Also, in the above-mentioned [5], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and of determining a pitch pattern change degree to the target pitch pattern for the input signal pitch pattern based on a combination of both changing trends, and the degradation degree calculation step (or means) may provide as the degradation degree to the pitch conversion step (or means) a sum of values that are the average pitch conversion amount, the average signal difference, and the pitch pattern change degree respectively weighted by predetermined coefficients.

As the above-mentioned [5]-[8], the combination of two or three of the average pitch conversion amount, the average signal difference, and the pitch pattern change degree described in the above-mentioned [2]-[4] can be used as the degradation degree.

[9] Also, a pitch conversion method (or device) according to one aspect of the present invention comprises: a degradation degree extraction step of (or means) inputting a voice state and a phonemic type of an input signal per predetermined processing unit, and extracting a degradation degree corresponding to the voice state and the phonemic type inputted from a database in which degradation degrees indicating how a waveform of the input signal degrades upon pitch conversion from an input signal pitch pattern to a target pitch pattern for the input signal pitch pattern are associated with all of combinations of voice states and phonemic types estimated to be recorded; and a pitch conversion step of (or means) performing the pitch conversion with predetermined data throughput depending on the degradation degree.

Namely, in this database, the combination of all of the voice states and the phonemic types estimated as the input signal are associated with the degradation degree to be recorded. Therefore, it is possible to accurately reduce the data throughput depending on the degradation of the sound quality which may actually occur.

[10] Also, a pitch conversion method (or device) according to one aspect of the present invention comprises: a degradation evaluation step of (or means) inputting an input signal pitch pattern per predetermined processing unit, a target pitch pattern for the input signal pitch pattern, and a voice state and a phonemic type of the input signal, and calculating a degradation degree indicating how a waveform of the input signal degrades upon pitch conversion from the input signal pitch pattern to the target pitch pattern; and a pitch conversion step of (or means) performing the pitch conversion with predetermined data throughput depending on the degradation degree.

Thus, the degradation degree can be calculated in consideration of both of the degradation degree based on the input signal pitch pattern and the target pitch pattern as described in the above-mentioned [1], and the degradation degree based on the voice state and the phonemic type of the input signal as described in the above-mentioned [9], thereby enabling the data throughput for the pitch conversion to be more accurately reduced while the degradation of sound quality is suppressed.

[11] Also, in the above-mentioned [10], the degradation evaluation step (or means) may include an average pitch conversion amount calculation step of (or means) calculating an average pitch conversion amount by dividing a sum of pitch differences between the target pitch pattern and the input signal pitch pattern per predetermined cycle by a sum of pitches of the input signal pitch pattern per predetermined cycle, a degradation degree extraction step of (or means) extracting a degradation degree corresponding to the voice state and the phonemic type inputted from a database in which the degradation degrees are associated with all of combinations of voice states and phonemic types estimated to be recorded, and a degradation degree calculation step of (or means) providing as the degradation degree to the pitch conversion step (or means) a sum of values that are the average pitch conversion amount and the extracted degradation degree respectively weighted by predetermined coefficients.

[12] Also, in the above-mentioned [10], the pitch conversion step (or means) may include a first and second pitch conversion steps (or means) depending on a level of the degradation degree, accordingly the degradation evaluation step (or means) may also include the identical first and second pitch conversion steps (or means), and the degradation evaluation step (or means) may further include an average signal difference calculation step of (or means) calculating an average signal difference by dividing a sum of power differences between a first pitch conversion result obtained by converting a part of the input signal pitch pattern per predetermined processing unit and the target pitch pattern at the first pitch conversion step (or means) and a second pitch conversion result obtained by converting a part of the input signal pitch pattern per predetermined processing unit and the target pitch pattern at the second pitch conversion step (or means) per predetermined cycle by a sum of powers of the second pitch conversion result per predetermined cycle, a degradation degree extraction step of (or means) extracting a degradation degree corresponding to the voice state and the phonemic type inputted from a database in which the degradation degrees are associated with all of combinations of voice states and phonemic types estimated to be recorded, and a degradation degree calculation step of (or means) providing as the degradation degree to the pitch conversion step (or means) a sum of values that are the average signal difference and the extracted degradation degree respectively weighted by predetermined coefficients.

[13] Also, in the above-mentioned [10], the degradation evaluation step (or means) may include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and determining a pitch pattern change degree to the target pitch pattern for the input signal pitch pattern based on a combination of both changing trends, a degradation degree extraction step of (or means) extracting a degradation degree corresponding to the voice state and the phonemic type inputted from a database in which the degradation degrees are associated with all of combinations of voice states and phonemic types estimated to be recorded, and a degradation degree calculation step of (or means) providing as the degradation degree to the pitch conversion step (or means) a sum of values that are the pitch pattern change degree and the extracted degradation degree respectively weighted by predetermined coefficients.

[14] Also, in the above-mentioned [11], the pitch conversion step (or means) may include a first and second pitch conversion steps (or means) depending on a level of the degradation degree, accordingly the degradation evaluation step (or means) may also include the identical first and second pitch conversion steps (or means), and the degradation evaluation step (or means) may further include an average signal difference calculation step of (or means) calculating an average signal difference by dividing a sum of power differences between a first pitch conversion result obtained by converting a part of the input signal pitch pattern per predetermined processing unit and the target pitch pattern at the first pitch conversion step (or means) and a second pitch conversion result obtained by converting a part of the input signal pitch pattern per predetermined processing unit and the target pitch pattern at the second pitch conversion step (or means) per predetermined cycle by a sum of powers of the second pitch conversion result per predetermined cycle, and the degradation degree calculation step (or means) may provide as the degradation degree to the pitch conversion step (or means) a sum of values that are the average pitch conversion amount, the extracted degradation degree, and the average signal difference respectively weighted by predetermined coefficients.

[15] Also, in the above-mentioned [11], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and determining a pitch pattern change degree to the target pitch pattern for the input signal pitch pattern based on a combination of both changing trends, and a degradation degree calculation step (or means) may provide as the degradation degree to the pitch conversion step (or means) a sum of values that are the average pitch conversion amount, the extracted degradation degree, and the pitch pattern change degree respectively weighted by predetermined coefficients.

[16] Also, in the above-mentioned [12], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and determining a pitch pattern change degree to the target pitch pattern for the input signal pitch pattern based on a combination of both changing trends, and a degradation degree calculation step (or means) may provide as the degradation degree to the pitch conversion step (or means) a sum of values that are the average signal difference, the extracted degradation degree, and the pitch pattern change degree respectively weighted by predetermined coefficients.

[17] Also, in the above-mentioned [14], the degradation evaluation step (or means) may further include a pitch pattern change degree calculation step of (or means) classifying changing trends of the input signal pitch pattern and the target pitch pattern respectively into any one of predetermined changing trends by calculating average pitches per predetermined time interval of the pitch pattern and by sequentially comparing the average pitches, and determining a pitch pattern change degree to the target pitch pattern for the input signal pitch pattern based on a combination of both changing trends, and a degradation degree calculation step (or means) may provide as the degradation degree to the pitch conversion step (or means) a sum of values that are the average pitch conversion amount, the extracted degradation degree, the average signal difference, and the pitch pattern change degree respectively weighted by predetermined coefficients.

As the above-mentioned [11]-[17], the combination of two, three, or four of the average pitch conversion amount, the average signal difference, the pitch pattern change degree, and the degradation degree extracted at the degradation degree extraction step can be used as the degradation degree.

According to the present invention, the data throughput can be reduced while the degradation of the sound quality due to the pitch conversion can be suppressed as much as possible, thereby enabling a processing congestion of a device to which the present invention is applied and a delay of the pitch conversion due to the congestion to be prevented. Also, a long-lived device can be realized.

Also, it is made possible to easily calculate or extract the degradation degree, so that circuits within the device can be simplified.

BRIEF DESCRIPTION OF THE DRAWINGS

The above and other objects and advantages of the invention will be apparent upon consideration of the following detailed description, taken in conjunction with the accompanying drawings, in which the reference numerals refer to like parts throughout and in which.

DESCRIPTION OF THE EMBODIMENTS

Embodiments [1]-[3] of a pitch conversion method and a device using the method according to the present invention will now be described in the following order by referring to FIGS. 1-23A, 23B.

Figure 1:
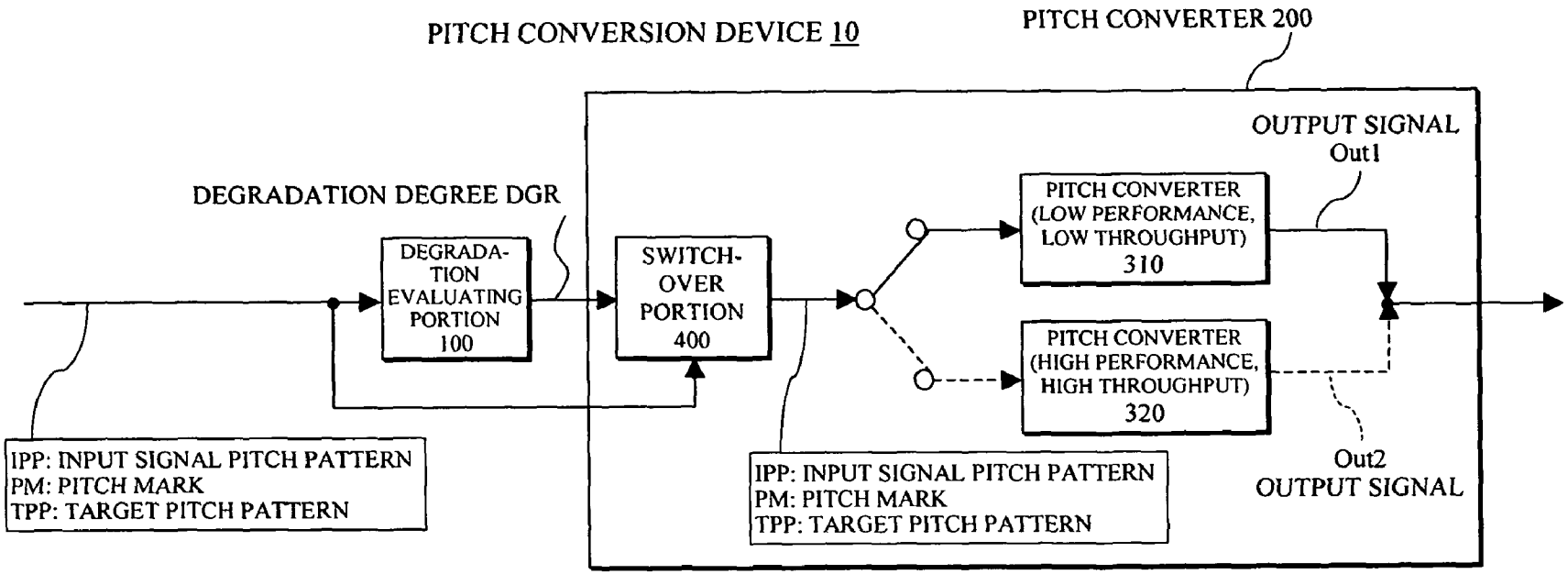
FIG. 1 is a block diagram showing an embodiment [1] of a pitch conversion method and device according to the present invention.
Figure 2:
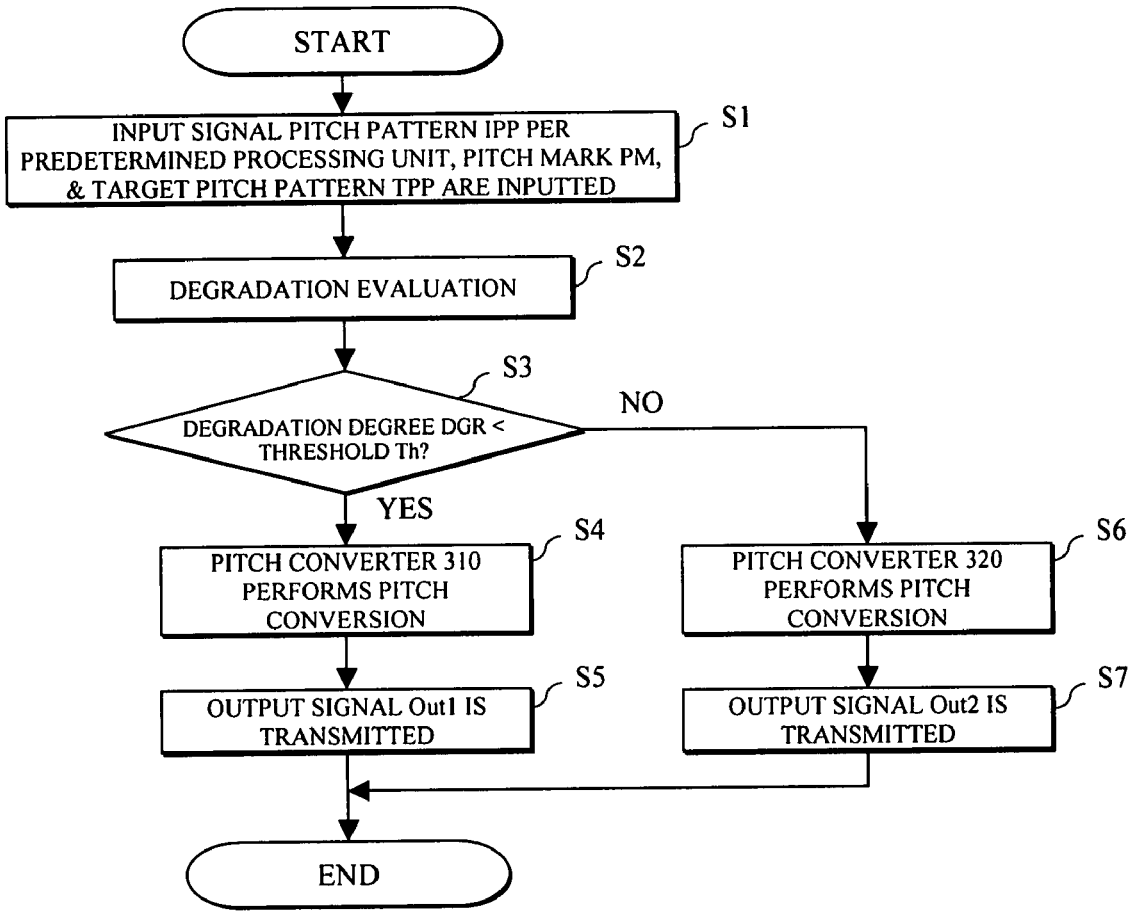
FIG. 2 is a flowchart showing an entire operation example of a pitch conversion method and device according to the present invention.
Figure 3:
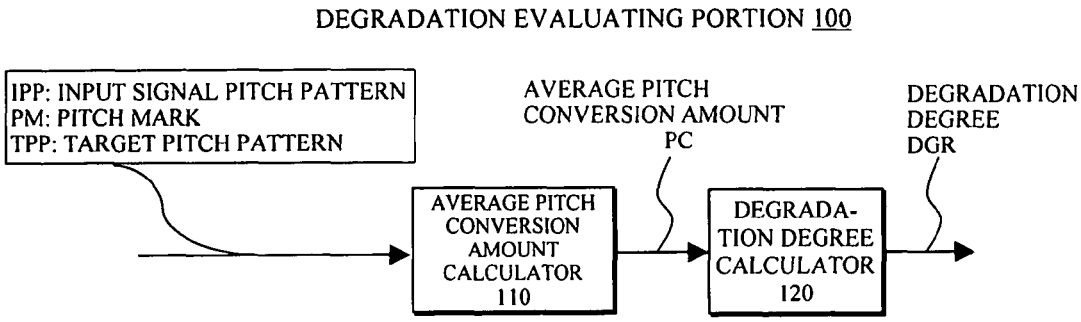
FIG. 3 is a block diagram showing an embodiment (1) of a degradation evaluating portion used for an embodiment [1] of the present invention.
Figure 4A:
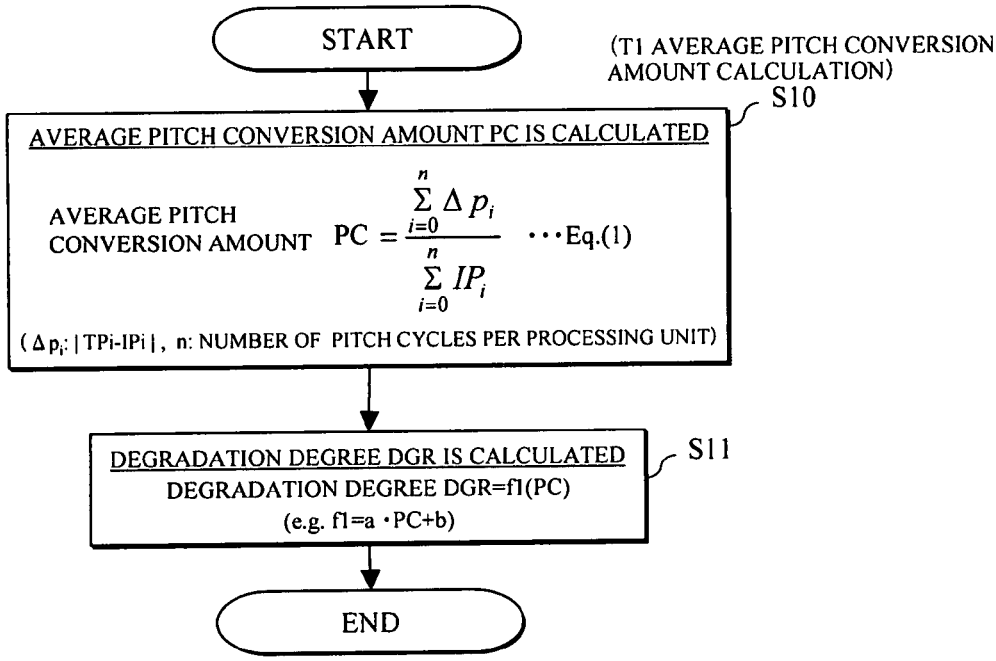
FIG. 4A is a flowchart showing an operation example (1) of a degradation evaluating portion used for an embodiment [1] of the present invention.
Figure 4B:
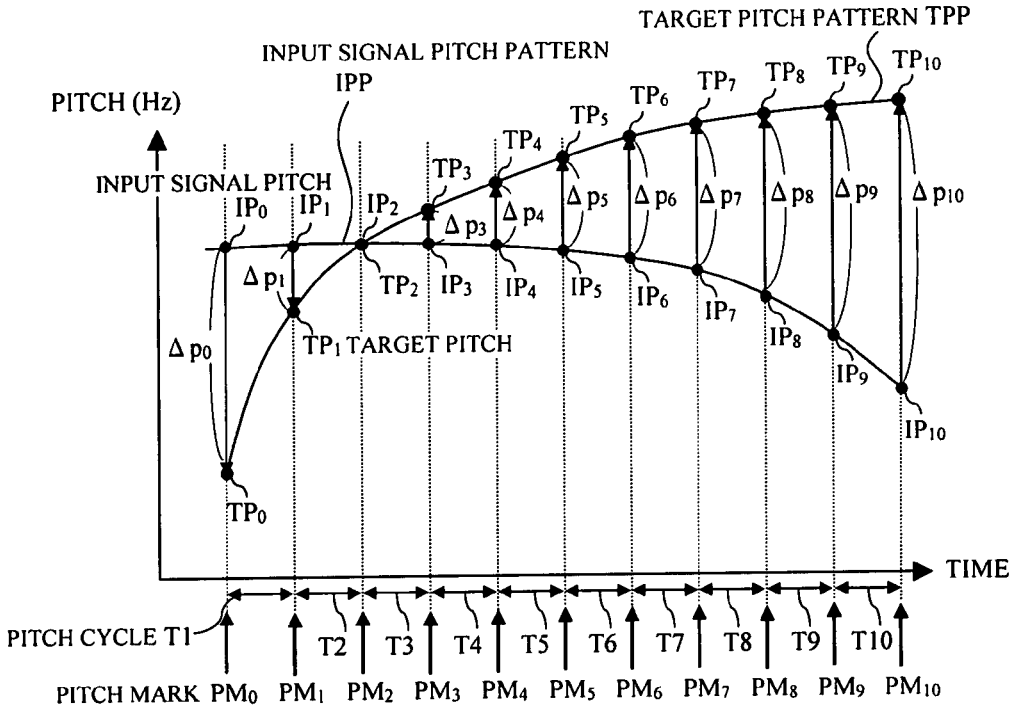
FIG. 4B is a temporal transition graph of an input signal pitch pattern and a target pitch pattern used for the present invention.
Figure 5:
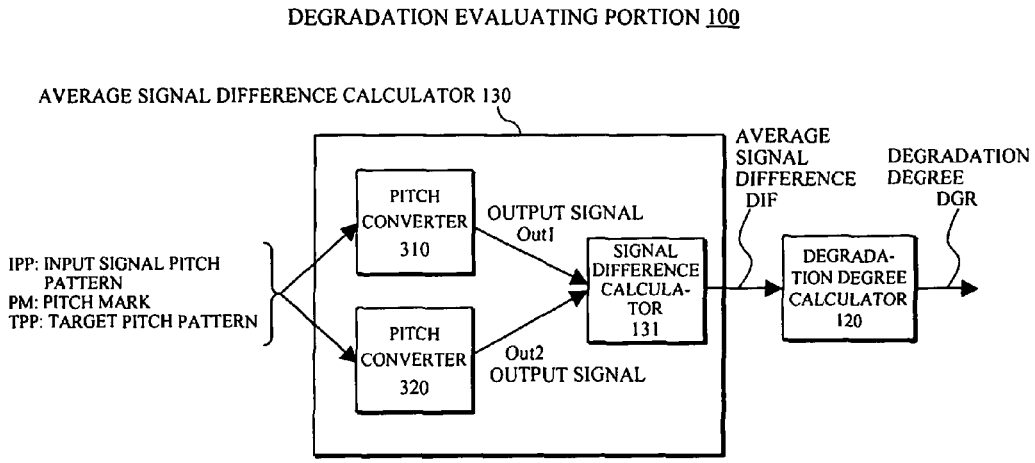
FIG. 5 is a block diagram showing an embodiment (2) of a degradation evaluating portion used for an embodiment [1] of the present invention.
Figure 6:
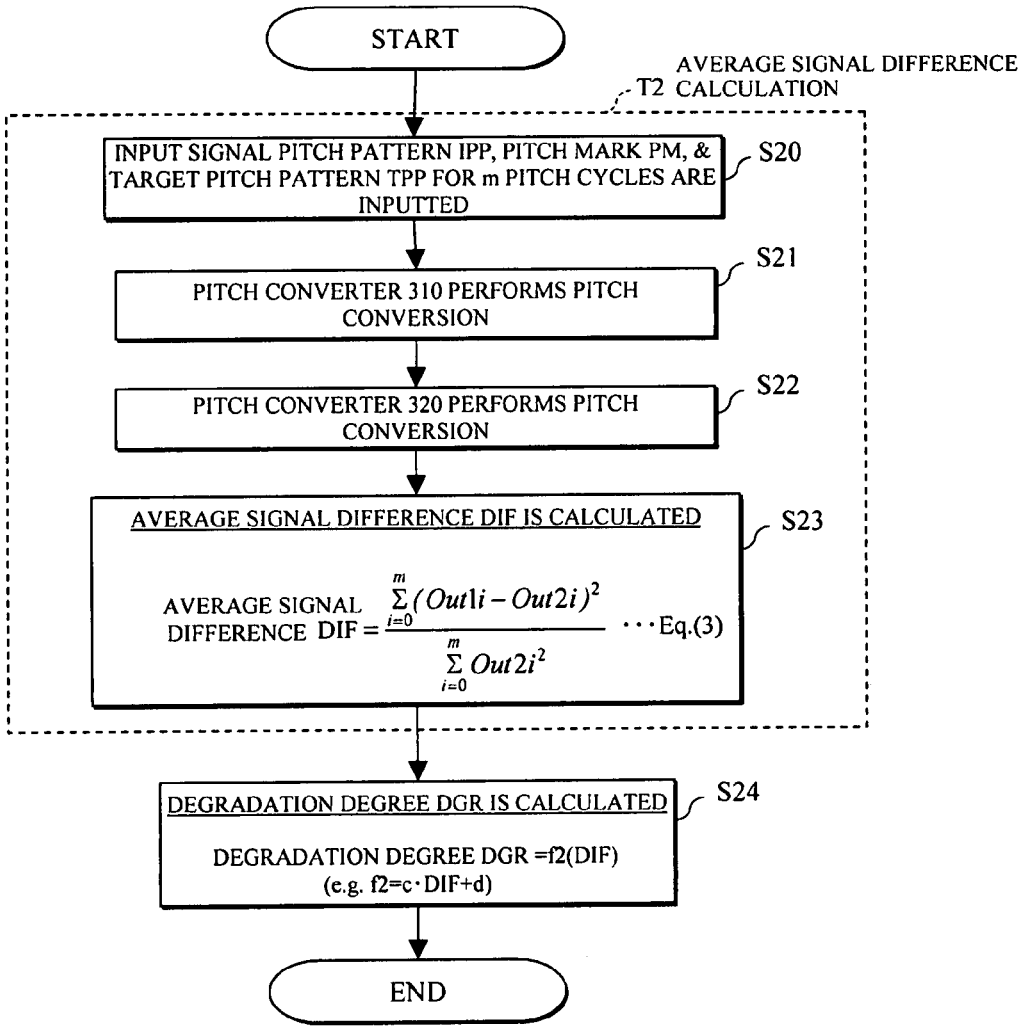
FIG. 6 is a flowchart showing an operation example (2) of a degradation evaluating portion used for an embodiment [1] of the present invention.
Figure 7:
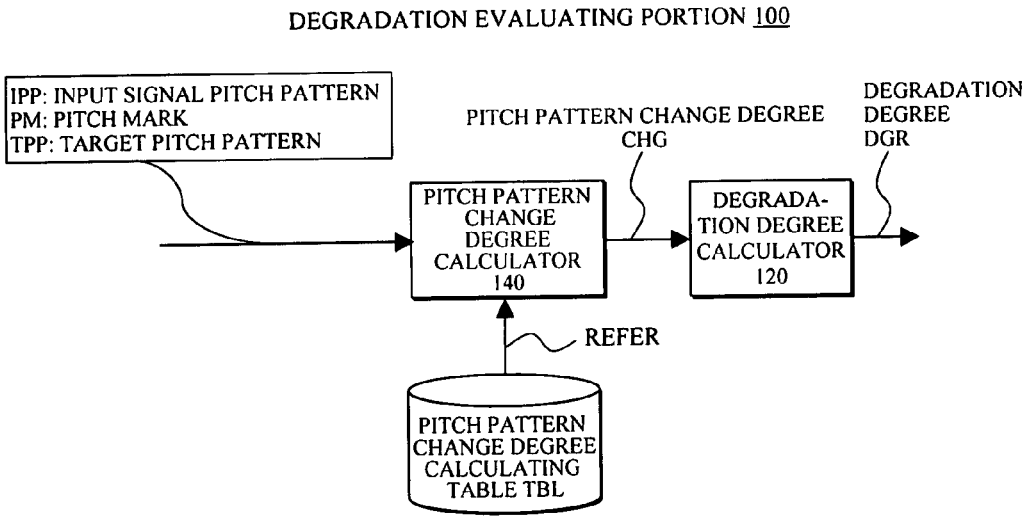
FIG. 7 is a block diagram showing an embodiment (3) of a degradation evaluating portion used for an embodiment [1] of the present invention.
Figure 8:
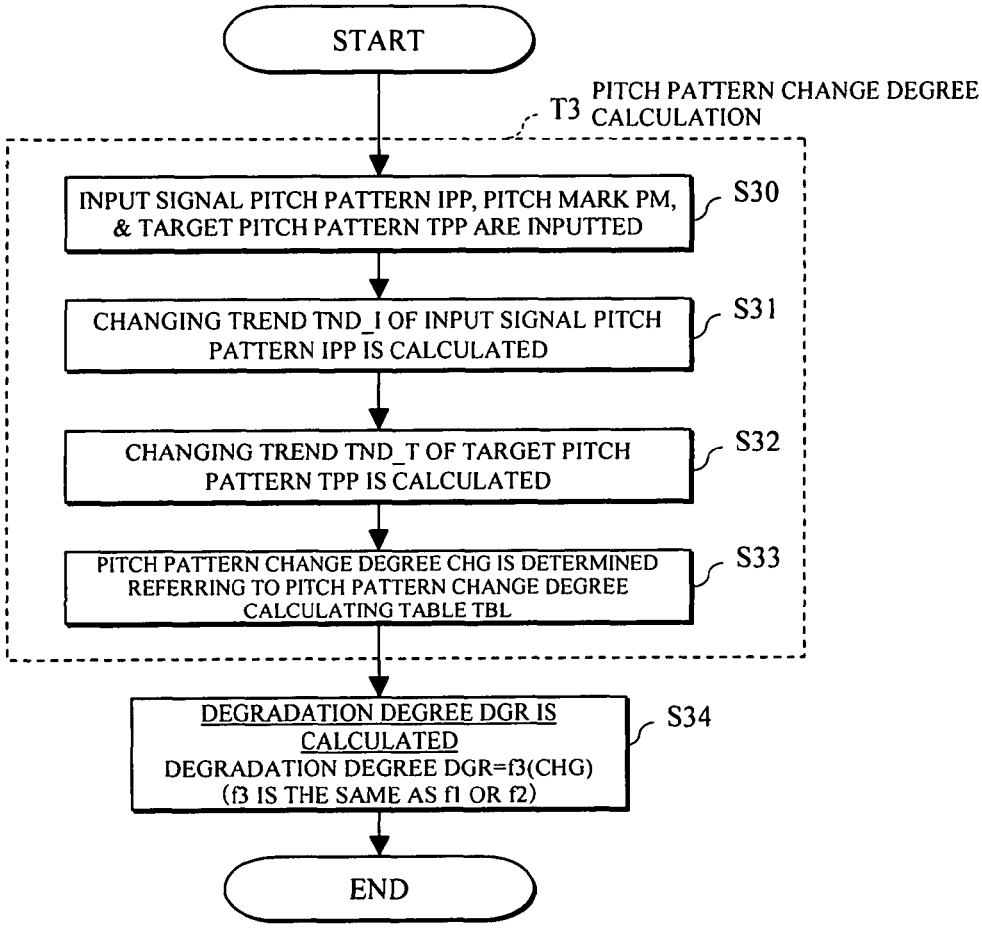
FIG. 8 is a flowchart showing an operation example (3) of a degradation evaluating portion used for an embodiment [1] of the present invention.
Figures 9A, 9B:
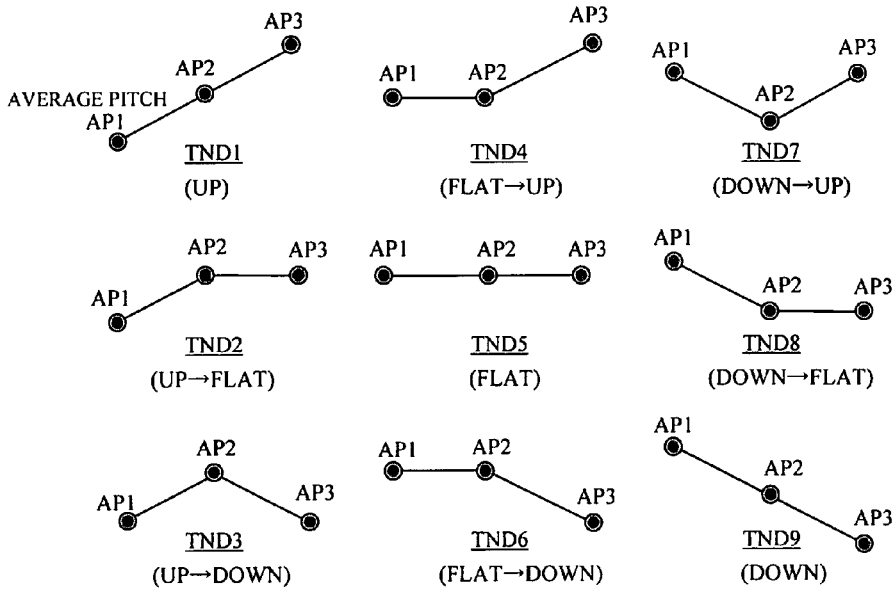
FIGS. 9A and 9B are diagrams showing examples of a pitch pattern change trend and a pitch pattern change degree calculating table used for the present invention.
Figure 10A:
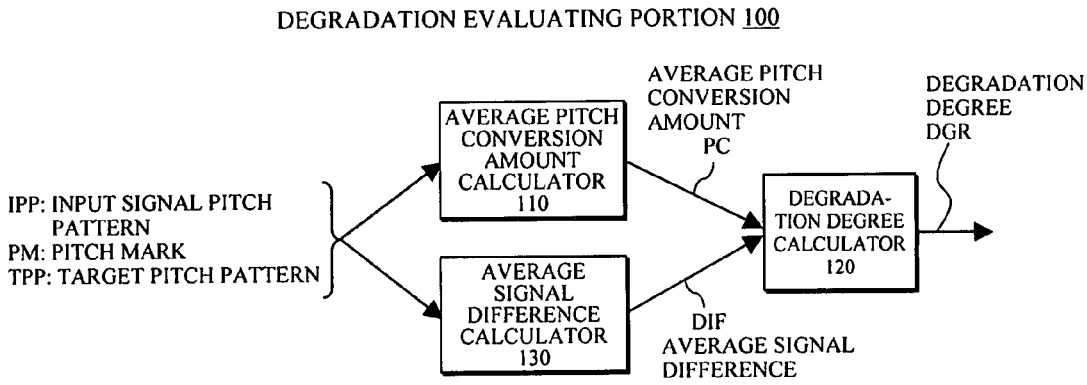
FIGS. 10A and 10B are block diagrams showing an embodiment (4) of a degradation evaluating portion used for the embodiment [1] of the present invention.
Figure 10B:
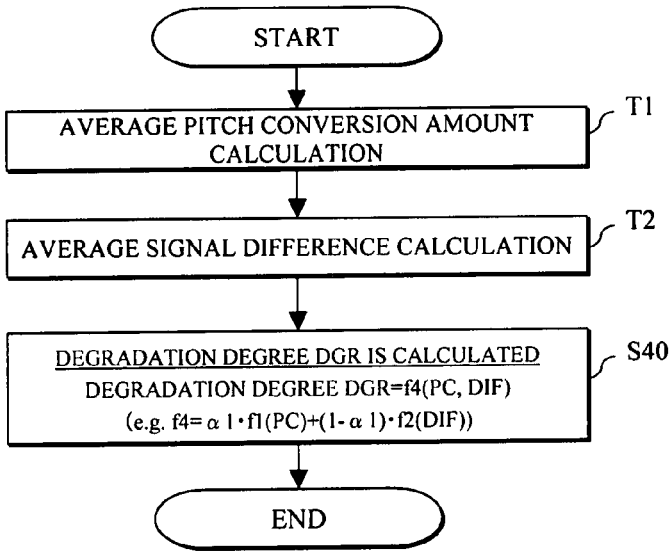
Figure 11A:
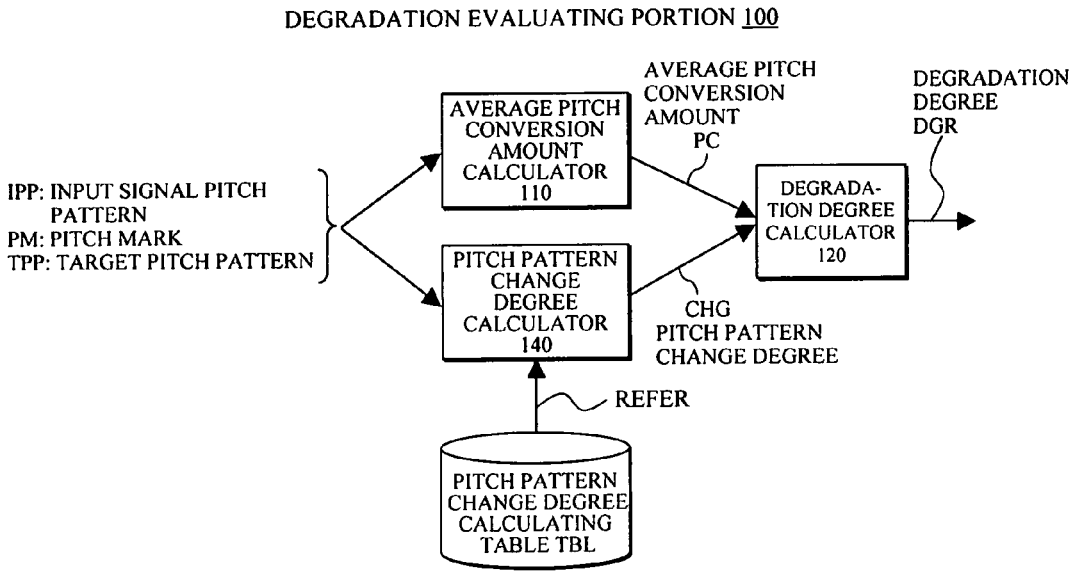
FIGS. 11A and 11B are block diagrams showing an embodiment (5) of a degradation evaluating portion used for the embodiment [1] of the present invention.
Figure 11B:
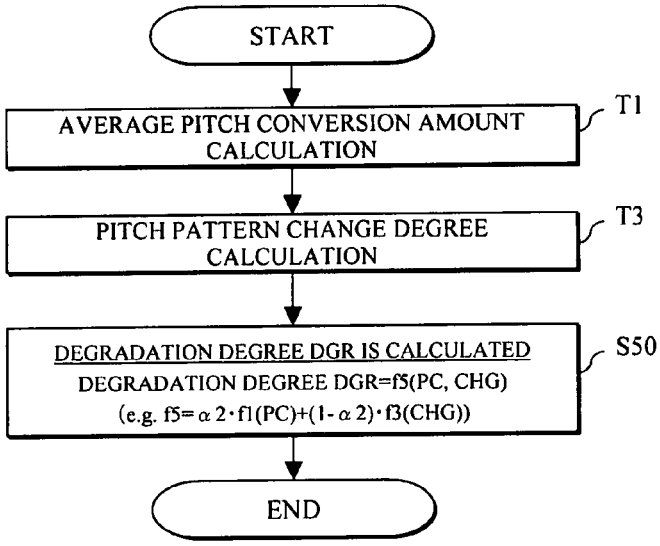
Figure 12A:
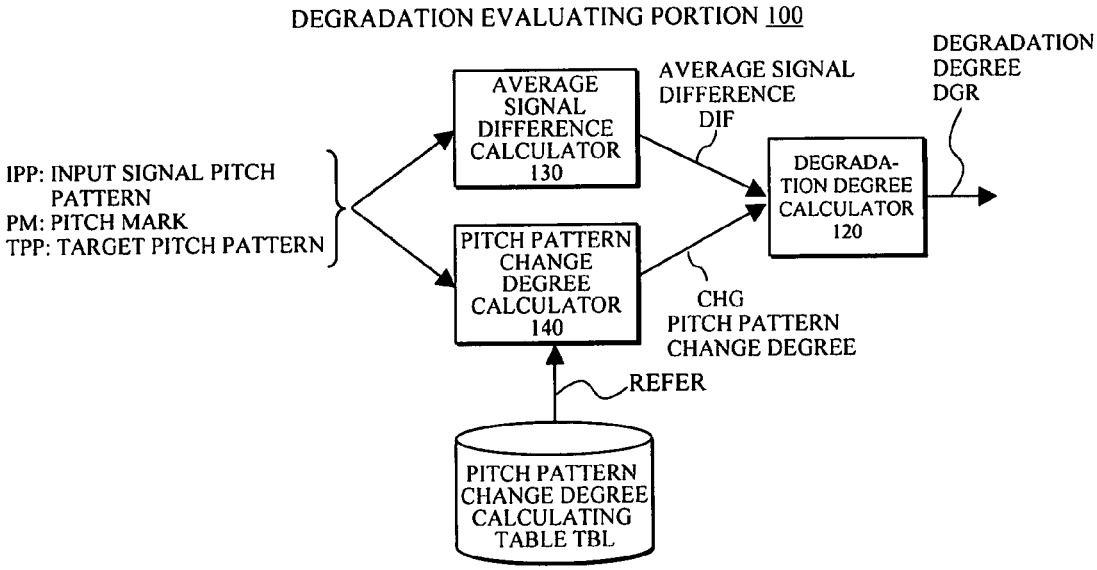
FIGS. 12A and 12B are block diagrams showing an embodiment (6) of a degradation evaluating portion used for the embodiment [1] of the present invention.
Figure 12B:
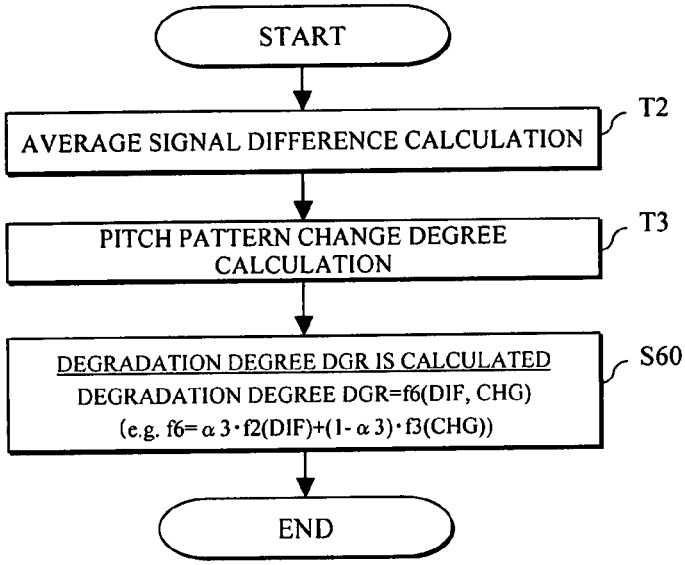
Figure 13A:
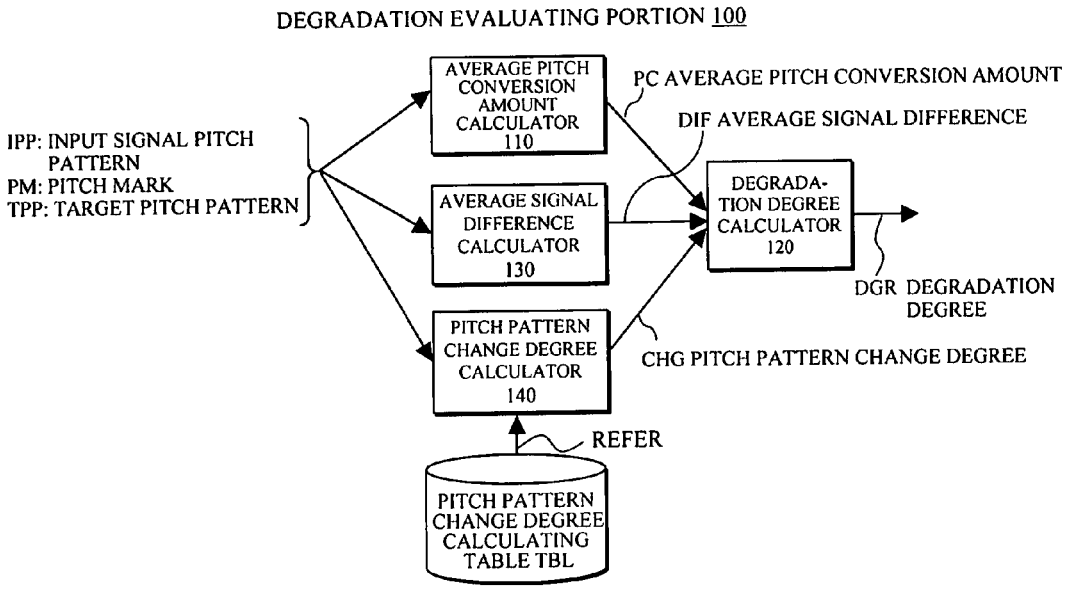
FIGS. 13A and 13B are block diagrams showing an embodiment (7) of a degradation evaluating portion used for the embodiment [1] of the present invention.
Figure 13B:
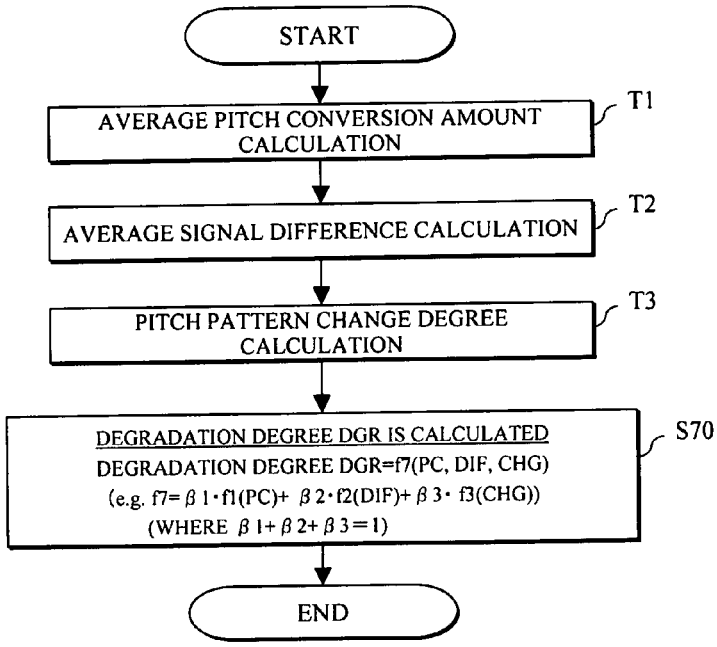
Figure 14:
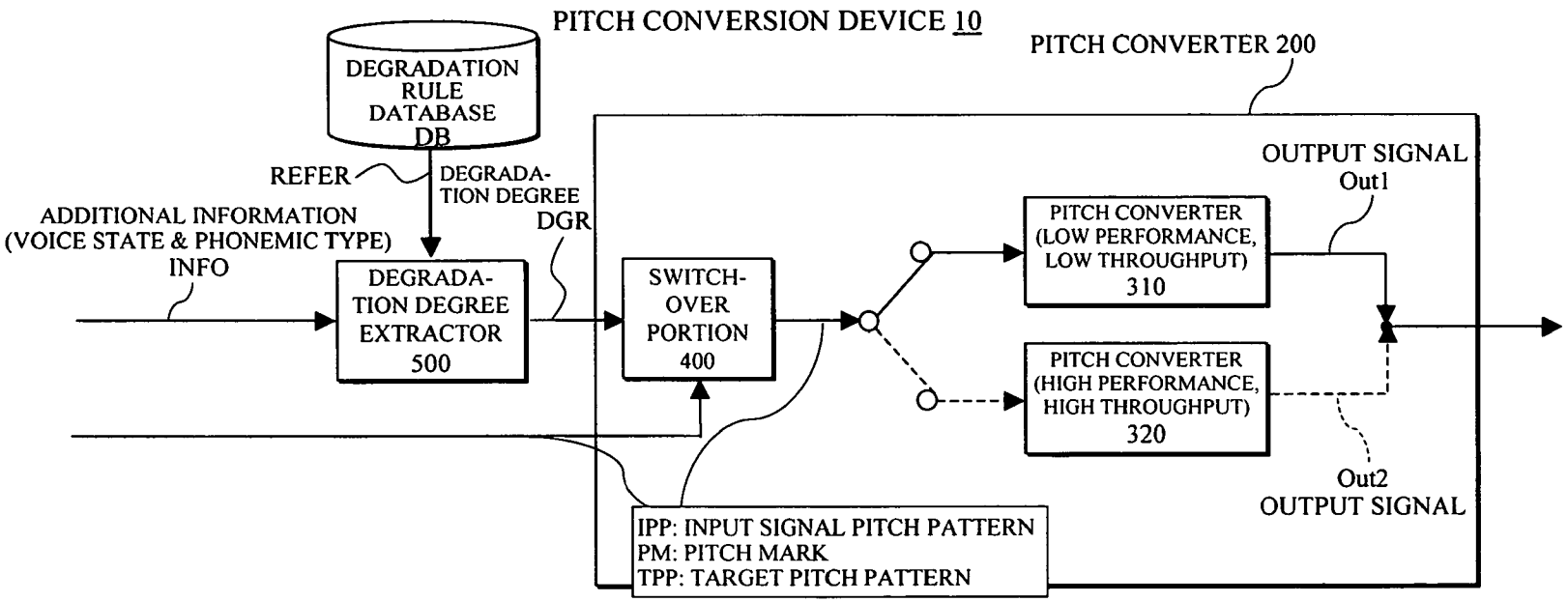
FIG. 14 is a block diagram showing an embodiment [2] of a pitch conversion method and device according to the present invention.
Figures 15A, 15B:
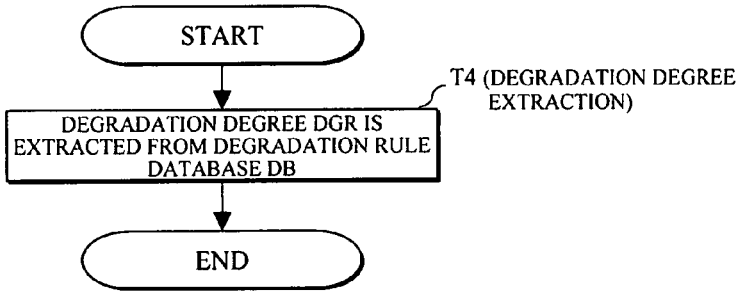
FIG. 15A is a flowchart showing an operation example of a degradation degree extractor.
FIG. 15B is a diagram showing an example of a degradation rule database used for an embodiment [2] of the present invention.
Figure 16:
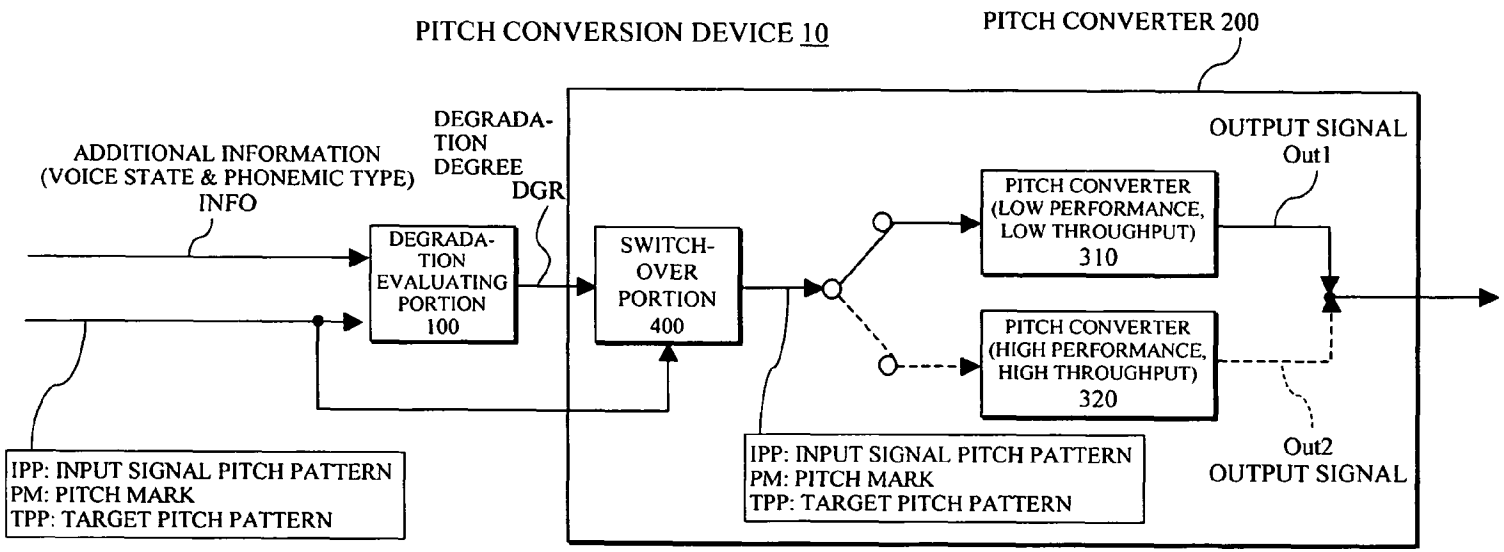
FIG. 16 is a block diagram showing an embodiment [3] of a pitch conversion method and device according to the present invention.
Figure 17A:
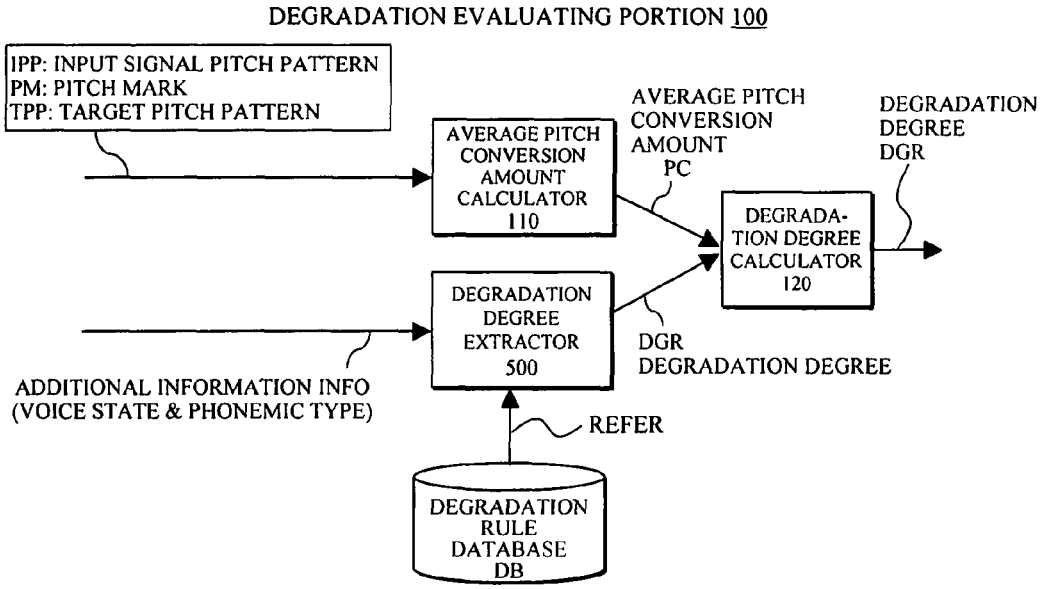
FIGS. 17A and 17B are block diagrams showing an embodiment (8) of a degradation evaluating portion used for an embodiment [3] of the present invention.
Figure 17B:
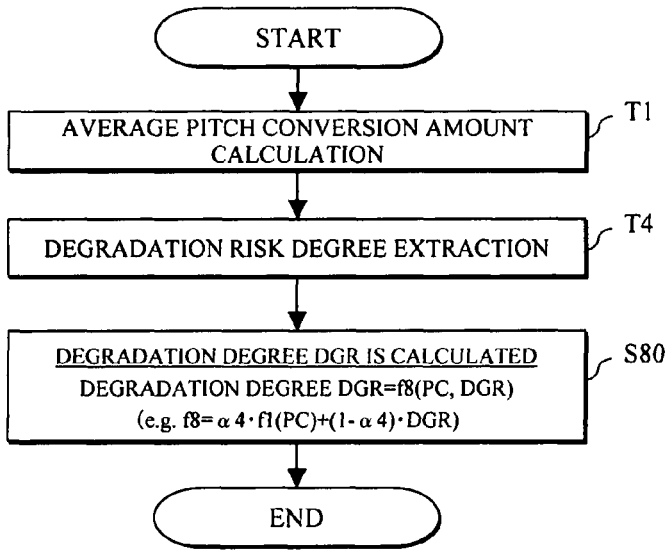
Figure 18A:
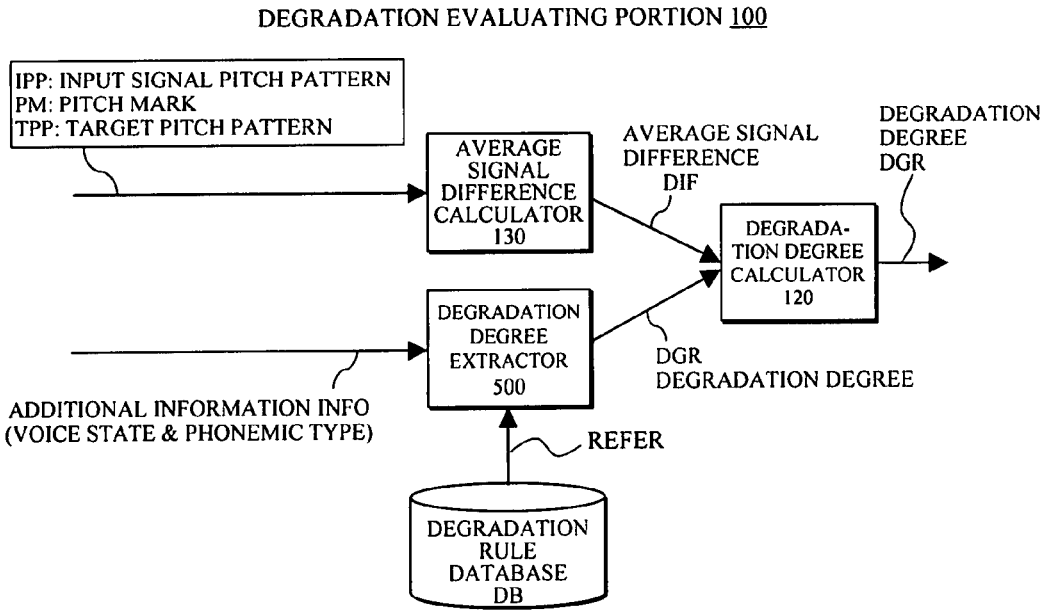
FIGS. 18A and 18B are block diagrams showing an embodiment (9) of a degradation evaluating portion used for an embodiment [3] of the present invention.
Figure 18B:
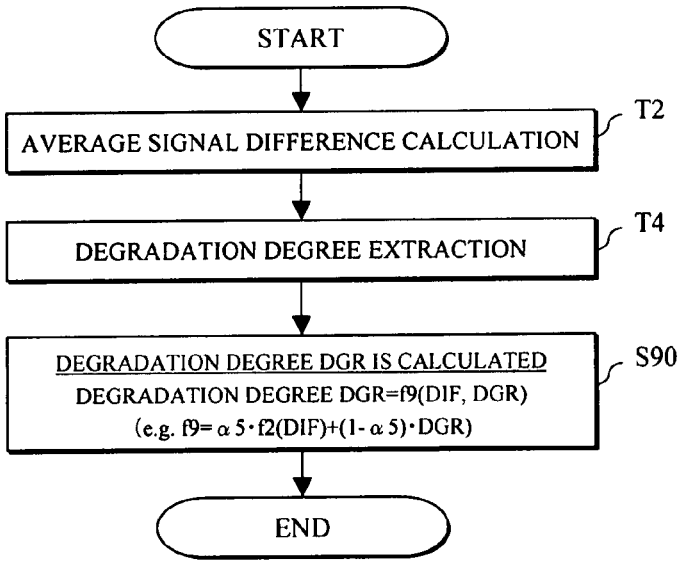
Figure 19A:
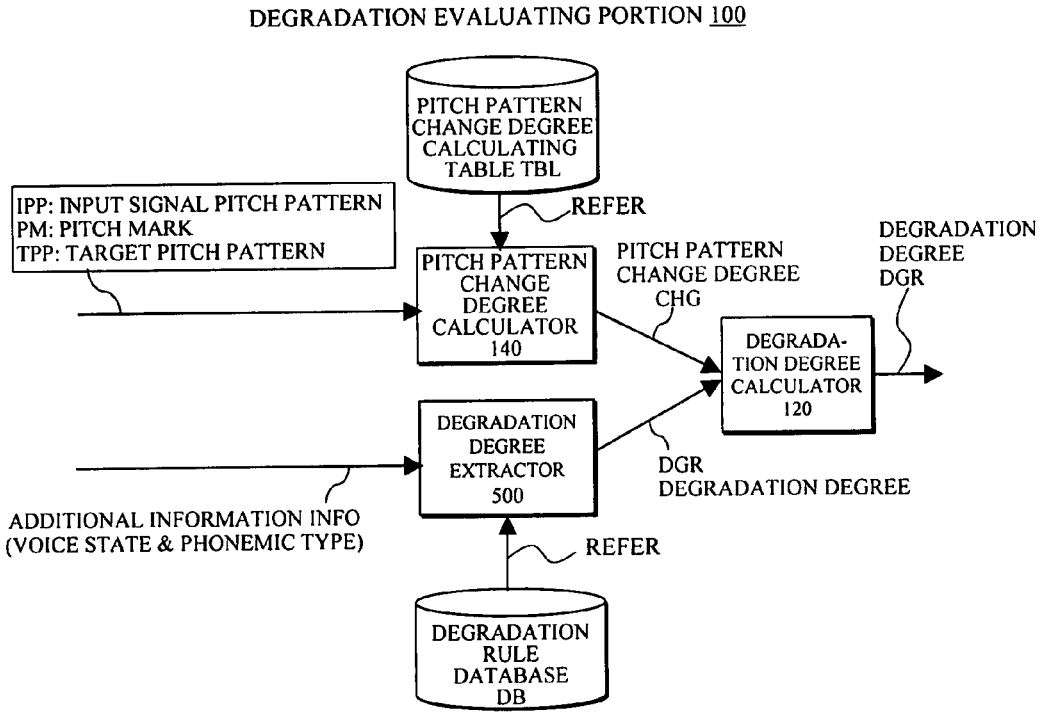
FIGS. 19A and 19B are block diagrams showing an embodiment (10) of a degradation evaluating portion used for an embodiment [3] of the present invention.
Figure 19B:
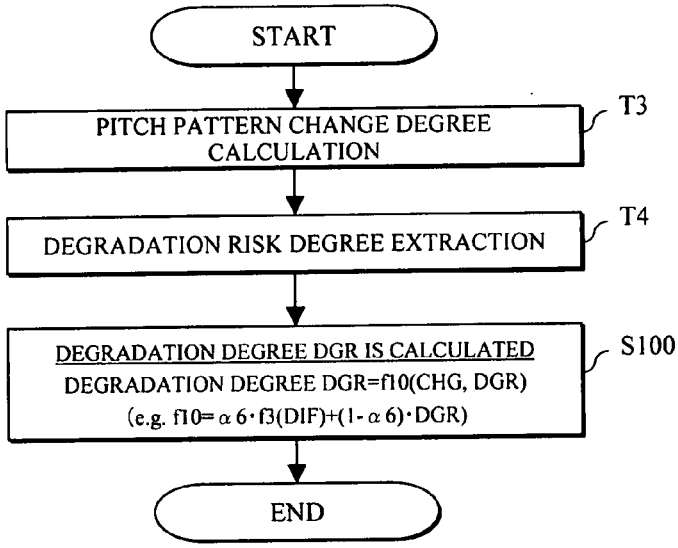
Figure 20A:
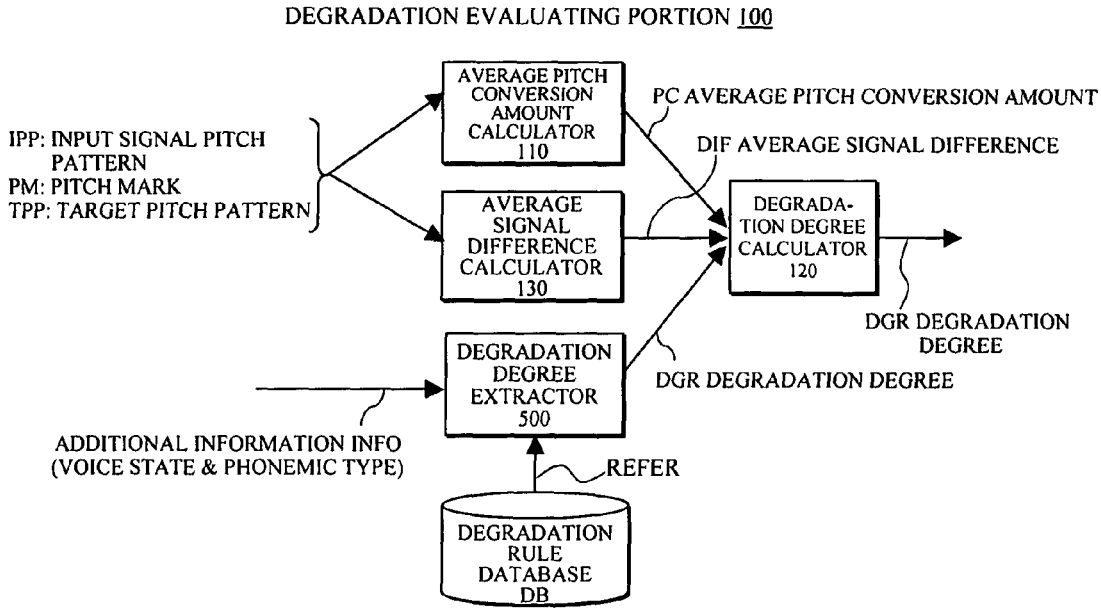
FIGS. 20A and 20B are block diagrams showing an embodiment (11) of a degradation evaluating portion used for an embodiment [3] of the present invention.
Figure 20B:
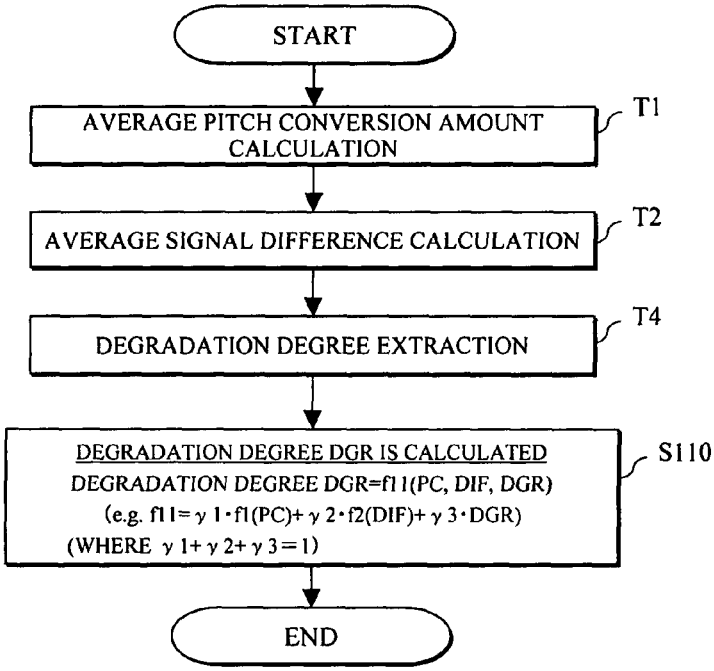
Figure 21A:
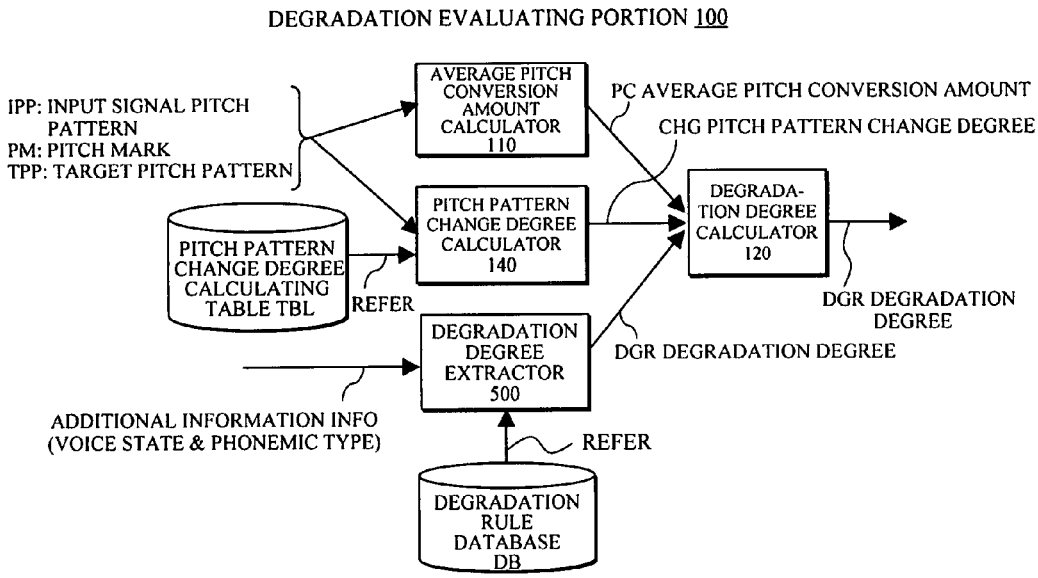
FIGS. 21A and 21B are block diagrams showing an embodiment (12) of a degradation evaluating portion used for an embodiment [3] of the present invention.
Figure 21B:
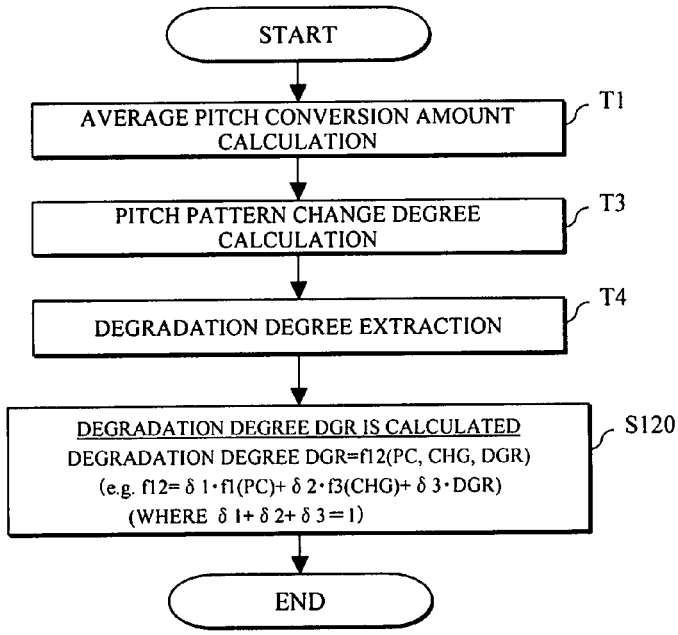
Figure 22A:
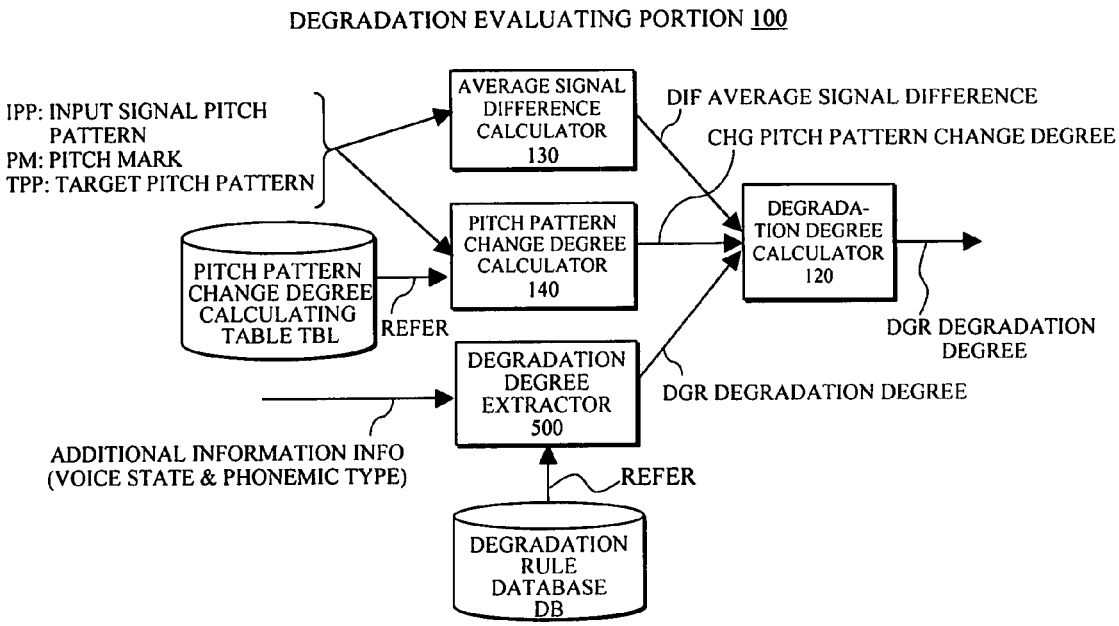
FIGS. 22A and 22B are block diagrams showing an embodiment (13) of a degradation evaluating portion used for an embodiment [3] of the present invention.
Figure 22B:
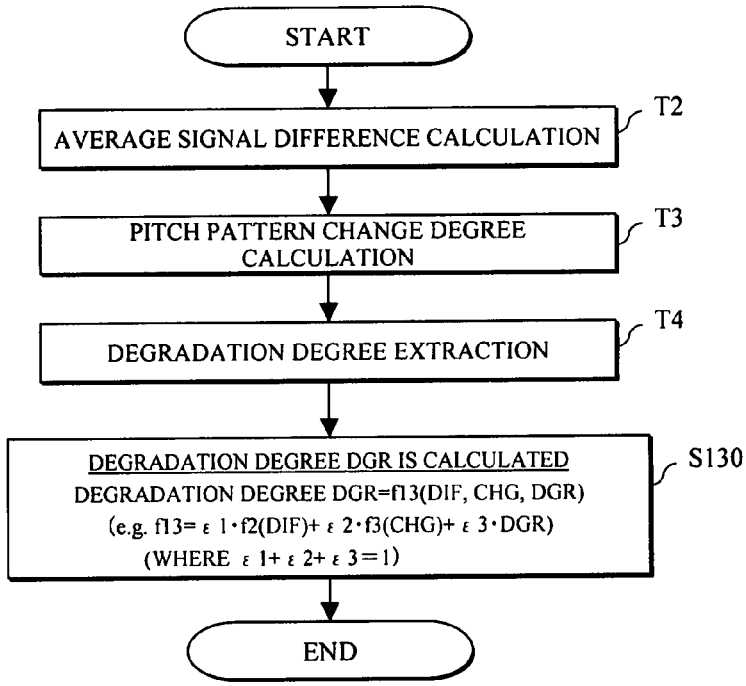
Figure 23A:
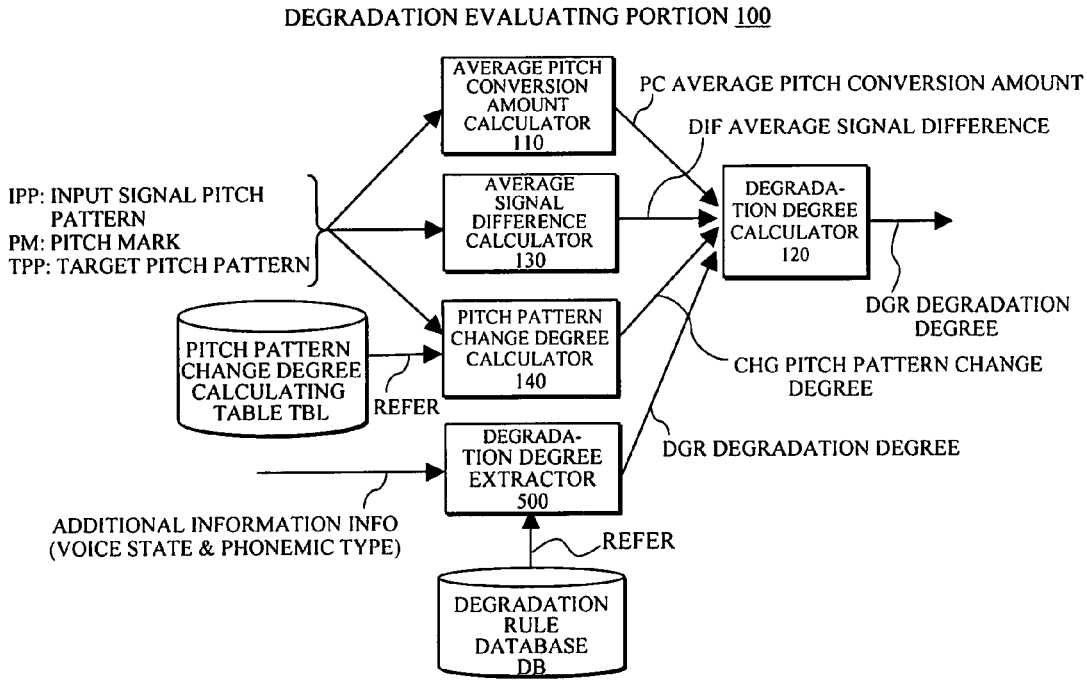
FIGS. 23A and 23B are block diagrams showing an embodiment (14) of a degradation evaluating portion used for an embodiment [3] of the present invention.
Figure 23B:
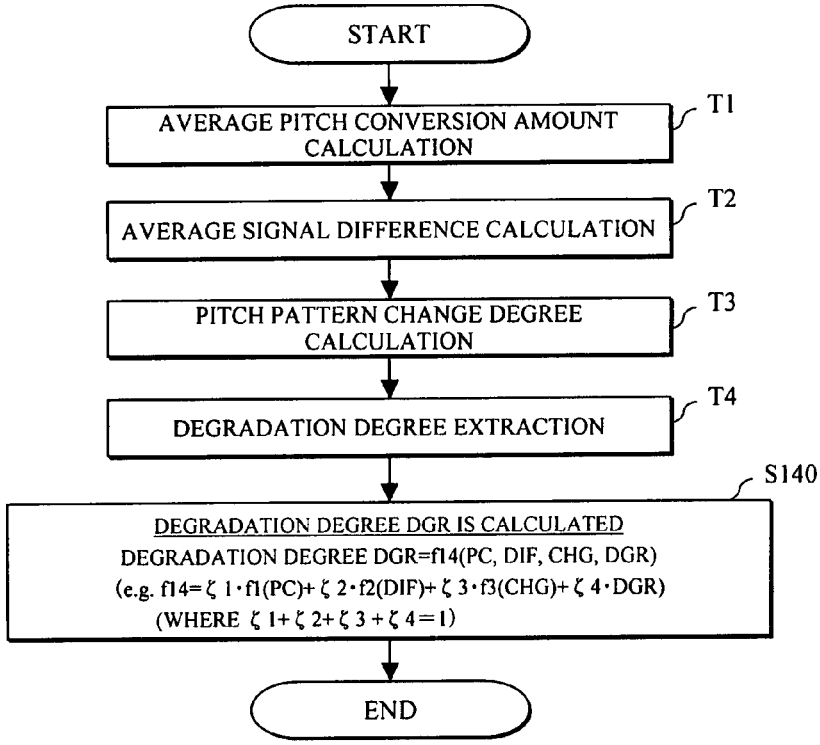
Figure 24:
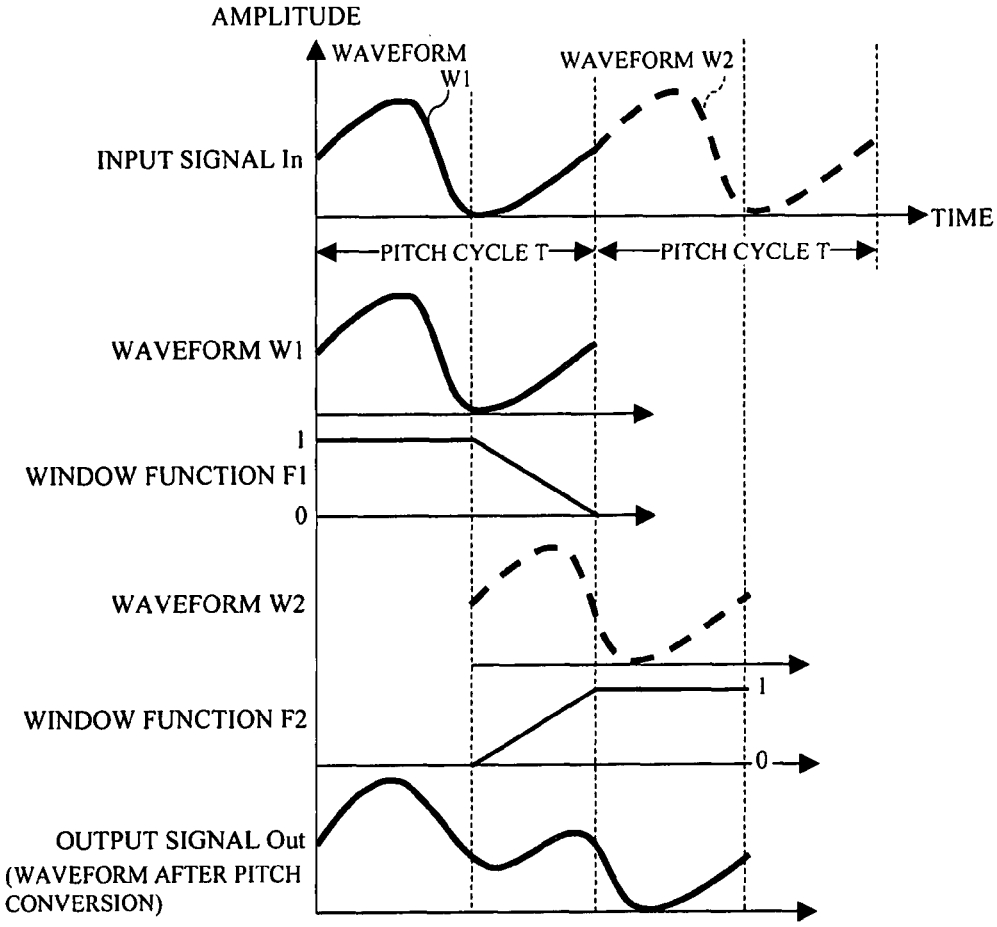
FIG.24 PRIOR ART
FIG. 24 is a time chart showing a prior art example [1] of a pitch conversion technology.

I. Embodiment [1]: FIGS. 1-13A, 13B
I.1. Arrangement (common to embodiments (1)-(7) of degradation evaluating portion): FIG. 1
I.2. Entire operation example (common to embodiments [2] and [3]): FIG. 2
I.3. Embodiments (1)-(7) of degradation evaluating portion: FIGS. 3-13A, 13B
I.3.A Embodiment (1) of degradation evaluating portion: FIGS. 3, 4A, and 4B
I.3.A.a Arrangement: FIG. 3
I.3.A.b Operation example: FIGS. 4A and 4B
I.3.B Embodiment (2) of degradation evaluating portion: FIGS. 5 and 6
I.3.B.a Arrangement: FIG. 5
I.3.B.b Operation example: FIG. 6
I.3.C Embodiment (3) of degradation evaluating portion: FIGS. 7-9A, 9B
I.3.C.a Arrangement: FIG. 7
I.3.C.b Operation example: FIGS. 8, 9A, and 9B
I.3.D Embodiment (4) of degradation evaluating portion: FIGS. 10A and 10B
I.3.E Embodiment (5) of degradation evaluating portion: FIGS. 11A and 11B
I.3.F Embodiment (6) of degradation evaluating portion: FIGS. 12A and 12B
I.3.G Embodiment (7) of degradation evaluating portion: FIGS. 13A and 13B
II. Embodiment [2]: FIGS. 14, 15A, and 15B
II. 1. Arrangement: FIG. 14
II. 2. Operation example: FIGS. 15A and 15B
III. Embodiment [3]: FIGS. 16-23A, 23B
III.1. Arrangement (common to embodiments (8)-(14) of degradation evaluating portion): FIG. 16
III.2. Operation example: FIGS. 17A, 17B-23A, 23B
III.3. Embodiments (8)-(14) of degradation evaluating portion: FIGS. 17A, 17B-23A, 23B
III.3.A Embodiment (8) of degradation evaluating portion: FIGS. 17A and 17B
III.3.B Embodiment (9) of degradation evaluating portion: FIGS. 18A and 18B
III.3.C Embodiment (10) of degradation evaluating portion: FIGS. 19A and 19B
III.3.D Embodiment (11) of degradation evaluating portion: FIGS. 20A and 20B
III.3.E Embodiment (12) of degradation evaluating portion: FIGS. 21A and 21B
III.3.F Embodiment (13) of degradation evaluating portion: FIGS. 22A and 22B
III.3.G Embodiment (14) of degradation evaluating portion: FIGS. 23A and 23B

I. Embodiment [1]

FIGS. 1-13A, 13B

I.1. Arrangement (Common to Embodiments (1)-(7) of Degradation Evaluating Portion): FIG. 1

A pitch conversion device 10 according to an embodiment [1] of the present invention shown in FIG. 1 is composed of a degradation evaluating portion 100 which receives an input signal pitch pattern IPP per predetermined processing unit, a target pitch pattern TPP for the pitch pattern IPP, and a pitch mark PM to calculate a degradation degree DGR, and a pitch converter 200 which performs a pitch conversion depending on the degradation degree DGR.

The pitch mark PM is data indicating positions of pitch cycles (periods) within the input signal pitch pattern IPP and the target pitch pattern TPP. Also, a predetermined processing unit is a data unit of e.g. a predetermined number of pitch cycles (namely, a predetermined number of pitch marks PM), a single phoneme, a single voice fragment (assembly of a plurality of phonemes), a single sentence, or the like.

Also, the pitch converter 200 is composed of a pitch converter 310 (i.e. a low-performance pitch converter using the pitch conversion technology such as the above-mentioned prior art example [1]) which receives the input signal pitch pattern IPP, the target pitch pattern TPP, and the pitch mark PM to execute the pitch conversion with small data throughput, a pitch converter 320 (i.e. a high-performance pitch converter using a pitch conversion technology such as mentioned in the above-mentioned prior art example [2]) which executes the pitch conversion with large data throughput, and a switchover portion 400 which determines whether the pitch conversion should be performed either by the pitch converter 310 or 320 and switches over from one to the other.

Hereinafter, the operation of this embodiment will be described. An entire operation example will be firstly described referring to FIG. 2. Then, embodiments (1)-(7) of the degradation evaluating portion 100 will be described referring to FIGS. 3-13A, 13B.

It is to be noted that the following description of the entire operation example is similarly applied to the embodiments [2] and [3] which will be described later except the calculation or extraction of the degradation degree DGR (hereinafter, referred to as degradation evaluation).

I.2. Entire Operation (Common to Embodiments [2] and [3]): FIG. 2

As shown in FIG. 2, the degradation evaluating portion 100 receives the input signal pitch pattern IPP per predetermined processing unit, the pitch mark PM, and the target pitch pattern TPP (at step S1), and provides the degradation degree DGR obtained by executing the degradation evaluating which will be described later to the switchover portion 400 within the pitch converter 200 (at step S2).

The switchover portion 400 compares the degradation degree DGR with a predetermined threshold "Th". With the result determining that the degradation degree is less than the threshold "Th" (at step S3), the switchover portion 400 provides the input signal pitch pattern IPP, the pitch mark PM, and the target pitch pattern TPP to the pitch converter 310.

The pitch converter 310 having received the input signal pitch pattern IPP, the pitch mark PM, and the target pitch pattern TPP executes the pitch conversion (at step S4), and transmits the output signal Out1 after the pitch conversion to the subsequent stage (at step S5).

On the other hand, with the result determining that the degradation degree is equal to or more than the threshold "Th" at the above-mentioned step S3, the switchover portion 400 provides the input signal pitch pattern IPP, the pitch mark PM, and the target pitch pattern TPP to the pitch converter 320.

The pitch converter 320 having received the input signal pitch pattern IPP, the pitch mark PM, and the target pitch pattern TPP executes the pitch conversion (at step S6), and transmits the output signal Out2 after the pitch conversion to the subsequent stage (at step S7).

I.3. Embodiments (1)-(7) of Degradation Evaluating Portion: FIGS. 3-13A, 13B I.3.A Embodiment (1) of Degradation Evaluating Portion: FIGS. 3, 4A, and 4B I.3.A.a Arrangement: FIG. 3

The degradation evaluating portion 100 shown in FIG. 3 is provided with an average pitch conversion amount calculator 110 which receives the input signal pitch pattern IPP, the pitch mark PM, and the target pitch pattern TPP to calculate an average pitch conversion amount PC, and a degradation degree calculator 120 which calculates the degradation degree DGR from the average pitch conversion amount PC.

I..3.A.b Operation Example: FIGS. 4A and 4B

As shown in FIG. 4A, the average pitch conversion amount calculator 110 calculates the average pitch conversion amount PC for the input signal according to the following equation (1) to be provided to the degradation degree calculator 120 (average pitch conversion amount calculation T1 of step S10).

$$\text{average pitch conversion amount } PC = \frac{\sum_{i=0}^{n} \Delta p_i}{\sum_{i=0}^{n} IP_i} \quad \text{Eq. (1)}$$

As shown in FIG. 4B, $\Delta p_i$ in Eq. (1) indicates the absolute value of a pitch difference between a target pitch $TP_i$ and an input signal pitch $IP_i$ at the position of a pitch cycle shown by a pitch mark $PM_i$. The average pitch conversion amount PC is calculated by dividing the sum of the $\Delta p_i$ (in the example of FIG. 4B, a pitch cycle number "n" per processing unit is assumed to be "10" (pitch cycles T1-T10)) by the sum of the input signal pitches $IP_i$.

The degradation degree calculator 120 calculates the degradation degree DGR by the following Eq. (2) based on the average pitch conversion amount PC to be provided to the switchover portion 400 (at step S11).

$$\begin{aligned} \text{degradation degree } DGR &= f1(PC) \\ &= a \cdot PC + b \end{aligned} \quad \text{Eq. (2)}$$

Coefficients "a" and "b" in the above-mentioned function f1 have only to be preset by an operator or the like so that a switchover between the pitch converters 310 and 320 depending on the degradation degree DGR is optimally performed. The same applies to coefficients in functions used for embodiments of the degradation evaluating portion which will be described later.

I.3.B Embodiment (2) of Degradation Evaluating Portion: FIGS. 5 and 6

I.3.B.a Arrangement: FIG. 5

The degradation evaluating portion 100 shown in FIG. 5 is provided with an average signal difference calculator 130 which inputs a part of the input signal pitch pattern IPP, the pitch mark PM, and the target pitch pattern TPP to calculate an average signal difference DIF, and the degradation degree calculator 120 which calculates the degradation degree DGR from the average signal difference DIF.

Also, the average signal difference calculator 130 includes the pitch converters 310 and 320 which are the same as the pitch converters 310 and 320 shown in FIG. 1, and a signal difference calculator 131 which calculates the average signal difference DIF from the output signals Out1 and Out2 of the pitch converters 310 and 320.

1.3.B.b Operation Example: FIG. 6

As shown in FIG. 6, the average signal difference calculator 130 executes an average signal difference calculation T2 to calculate the average signal difference DIF of the output signal Out1 from the output signal Out2.

Namely, the average signal difference calculator 130 inputs the input signal pitch pattern IPP, the pitch mark PM, and the target pitch pattern TPP for the pitch cycles "m" (smaller number than the pitch cycle number per processing unit) to be respectively provided to the pitch converters 310 and 320 (at step S20).

The pitch converters 310 and 320 respectively execute the pitch conversion, and provides the output signals Out1 and Out2 after the pitch conversion to the signal difference calculator 131 (at steps S21 and S22).

The signal difference calculator 131 having received the output signals Out1 and Out2 calculates the average signal difference DIF according to the following Eq. (3) to be provided to the degradation degree calculator 120 (at step S23).

$$\text{average signal difference } DIF = \frac{\sum_{i=0}^{m} (\text{Out } 1i - \text{Out } 2i)^2}{\sum_{i=0}^{m} \text{Out } 2i^2} \quad \text{Eq. (3)}$$

$\text{Out}1_i$ and $\text{Out}2_i$ in Eq. (3) indicate pitch conversion results obtained by the pitch conversion to an input signal pitch and a target pitch at the position of the pitch cycle shown by a pitch mark $PM_i$ (see FIG. 4B) by the pitch converters 310 and 320 respectively. By dividing the sum of the power difference between the pitch conversion results $\text{Out}1_i$ and $\text{Out}2_i$ by the sum of powers of the pitch conversion results $\text{Out}2_i$, the average signal difference DIF is calculated.

The degradation degree calculator 120 calculates the degradation degree DGR by the following Eq. (4) based on the average signal difference DIF to be provided to the switchover portion 400 (at step S24).

$$\begin{aligned} \text{degradation degree } DGR &= f2(DIF) \\ &= c \cdot DIF + d \end{aligned} \quad \text{Eq. (4)}$$

("*c*" and "*d*" are coefficients)

I.3.C Embodiments (3) of Degradation Evaluating Portion: FIGS. 7-9A, 9B I.3.C.a Arrangement: FIG. 7

The degradation evaluating portion 100 shown in FIG. 7 is provided with a pitch pattern change degree calculating table TBL in which a change trend that the input signal pitch pattern IPP and the target pitch pattern TPP may transition is associated with a pitch pattern change degree CHG to be recorded, a pitch pattern change degree calculator 140 which receives the input signal pitch pattern IPP, the pitch mark PM, and the target pitch pattern TPP, and determines the pitch pattern change degree CHG by referring to the table TBL to be outputted, and the degradation degree calculator 120 which calculates the degradation degree DGR from the pitch pattern change degree CHG.

I.3.C.b Operation Example: FIGS. 8, 9A, and 9B

As shown in FIG. 8, the pitch pattern change degree calculator 140 executes a pitch pattern change degree calculation T3 to determine the pitch pattern change degree CHG to the target pitch pattern TPP with respect to the input signal pitch pattern IPP.

Namely, the pitch pattern change degree calculator 140 receives the input signal pitch pattern IPP, the pitch mark PM, and the target pitch pattern TPP (at step S30), and calculates a change trend TND_I of the input signal pitch pattern IPP and a change trend TND_T of the target pitch pattern TPP (hereinafter, occasionally represented by a reference character TND) (at steps S31 and S32).

The pitch pattern change degree calculator 140 calculates average pitches AP1-AP3 (hereinafter, occasionally represented by a reference character AP) for three predetermined time intervals of the pitch pattern (e.g. time that is a pitch cycle divided into three, shown by the pitch mark PM), as shown in FIG. 9A, sequentially compares the average pitches AP1-AP3, and classifies the pitch pattern change trends TND into any one of nine pitch pattern change trends TND1-TND9.

If the average pitches AP1-AP3 of the input signal pitch pattern satisfy the relationship of AP1<AP2<AP3 (namely, a change trend that the average pitch AP gradually increases) for example, the pitch pattern change degree calculator 140 classifies the input signal pitch pattern change trend TND_I into a pitch pattern change trend TND1.

The pitch pattern change degree calculator 140 determines the pitch pattern change degree CHG from the combination of the input signal pitch pattern change trend TND_I and the target pitch pattern change trend TND_T by referring to the pitch pattern change degree calculating table TBL shown in FIG. 9B (at step S33).

As shown, the pitch pattern change degree calculating table TBL is set so that as the difference between the input signal pitch pattern change trend TND_I and the target pitch pattern change degree TND_T becomes large, a larger value is obtained as the pitch pattern change degree CHG.

When the input signal pitch pattern change trend TND_I and the target pitch pattern change trend TND_T are respectively classified into a pitch pattern change trend TND3 (change trend in which the average pitch AP changes from up to down) and a pitch pattern change trend TND7 (change trend in which the average pitch AP changes from down to up) (namely, when the difference of the pitch pattern change trend TND is the largest) for example, the pitch pattern change degree calculator 140 determines the pitch pattern change degree CHG to be "4" (maximum value) by referring to the pitch pattern change degree calculating table TBL.

The degradation degree calculator 120 calculates the degradation degree DGR by the following Eq. (5) based on the pitch pattern change degree CHG to be provided to the switchover portion 400 (at step S34).

$$\text{degradation degree DGR}=f3(CHG) \qquad \text{Eq. (5)}$$

For the above-mentioned function f3, the same function as the function f1 or f2 described in the above-mentioned embodiment (1) or (2) of the degradation evaluating portion can be used.

I..3.D Embodiment (4) of Degradation Evaluating Portion: FIGS. 10A and 10B The degradation evaluating portion 100 shown in FIG. 10A is provided with the average signal difference calculator 130 which is the same as that of the above-mentioned embodiment (2) of the degradation evaluating portion, in addition to the arrangement of the above-mentioned embodiment (1) of the degradation evaluating portion. However, this embodiment is different from the embodiment (2) in that the degradation degree calculator 120 calculates the degradation degree DGR from the average pitch conversion amount PC and the average signal difference DIF respectively provided from the average pitch conversion amount calculator 110 and the average signal difference calculator 130.

In operation, as shown in FIG. 10B, the average pitch conversion amount calculator 110 and the average signal difference calculator 130 respectively execute the above-mentioned average pitch conversion amount calculation and average signal difference calculation to calculate the average pitch conversion amount PC and the average signal difference DIF (at steps T1 and T2).

The degradation degree calculator 120 calculates the degradation degree DGR by the following Eq. (6) based on the average pitch conversion amount PC and the average signal difference DIF to be provided to the switchover portion 400 (at step S40).

$$\begin{aligned}\text{degradation degree } DGR &= f4(PC, DIF) \\ &= \alpha 1 \cdot f1(PC) + (1-\alpha 1)\cdot f2(DIF)\end{aligned} \qquad \text{Eq. (6)}$$

($\alpha 1$ is coefficient)

I.3.E Embodiment (5) of Degradation Evaluating Portion: FIGS. 11A and 11B The degradation evaluating portion 100 shown in FIG. 11A is provided with the pitch pattern change degree calculator 140 and the pitch pattern change degree calculating table TBL which are the same as those of the above-mentioned embodiment (3) of the degradation evaluating portion, in addition to the arrangement of the above-mentioned embodiment (1) of the degradation evaluating portion. However, this embodiment is different from the embodiment (3) in that the degradation degree calculator 120 calculates the degradation degree DGR based on the average pitch conversion amount PC and the pitch pattern change degree CHG respectively provided from the average pitch conversion amount calculator 110 and the pitch pattern change degree calculator 140.

In operation, as shown in FIG. 11B, the average pitch conversion amount calculator 110 and the pitch pattern change degree calculator 140 respectively execute the above-mentioned average pitch conversion amount calculation and pitch pattern change degree calculation to calculate the average pitch conversion amount PC and the pitch pattern change degree CHG (at steps T1 and T3).

The degradation degree calculator 120 calculates the degradation degree DGR by the following Eq. (7) based on the average pitch conversion amount PC and the pitch pattern change degree CHG to be provided to the switchover portion 400 (at step S50).

$$\text{degradation degree } DGR = f5(PC, CHG) = \alpha 2 \cdot f1(PC) + (1 - \alpha 2) \cdot f3(CHG) \quad \text{Eq. (7)}$$

($\alpha 2$ is coefficient)

I.3.F Embodiment (6) of Degradation Evaluating Portion: FIGS. 12A and 12B The degradation evaluating portion 100 shown in FIG. 12A is provided with the pitch pattern change degree calculator 140 and the pitch pattern change degree calculating table TBL which are the same as those of the above-mentioned embodiment (3) of the degradation evaluating portion, in addition to the arrangement of the above-mentioned embodiment (2) of the degradation evaluating portion. However, this embodiment is different from the embodiment (3) in that the degradation degree calculator 120 calculates the degradation degree DGR based on the average signal difference DIF and the pitch pattern change degree CHG respectively provided from the average signal difference calculator 130 and the pitch pattern change degree calculator 140.

In operation, as shown in FIG. 12B, the average signal difference calculator 130 and the pitch pattern change degree calculator 140 respectively execute the above-mentioned average signal difference calculation and pitch pattern change degree calculation to calculate the average signal difference DIF and the pitch pattern change degree CHG (at steps T2 and T3).

The degradation degree calculator 120 calculates the degradation degree DGR by the following Eq. (8) based on the average signal difference DIF and the pitch pattern change degree CHG to be provided to the switchover portion 400 (at step S60).

$$\text{degradation degree } DGR = f6(DIF, CHG) = \alpha 3 \cdot f2(DIF) + (1 - \alpha 3) \cdot f3(CHG) \quad \text{Eq. (8)}$$

($\alpha 3$ is coefficient)

I.3.G Embodiment (7) of Degradation Evaluating Portion: FIGS. 13A and 13B The degradation evaluating portion 100 shown in FIG. 13A is provided with the pitch pattern change degree calculator 140 and the pitch pattern change degree calculating table TBL which are the same as those of the above-mentioned embodiment (3) of the degradation evaluating portion, in addition to the arrangement of the above-mentioned embodiment (4) of the degradation evaluating portion. However, this embodiment is different from the embodiment (3) in that the degradation degree calculator 120 calculates the degradation degree DGR based on the average pitch conversion amount PC, the average signal difference DIF, and the pitch pattern change degree CHG respectively provided from the average pitch conversion amount calculator 110, the average signal difference calculator 130, and the pitch pattern change degree calculator 140.

In operation, as shown in FIG. 13B, the average pitch conversion amount calculator 110, the average signal difference calculator 130, and the pitch pattern change degree calculator 140 respectively execute the above-mentioned average pitch conversion amount calculation, average signal difference calculation, and pitch pattern change degree calculation to respectively calculate the average pitch conversion amount PC, the average signal difference DIF, and the pitch pattern change degree CHG (at steps T1-T3).

The degradation degree calculator 120 calculates the degradation degree DGR by the following Eq. (9) based on the average pitch conversion amount PC, the average signal difference DIF, and the pitch pattern change degree CHG to be provided to the switchover portion 400 (at step S70).

$$\text{degradation degree } DGR = f7(PC, DIF, CHG) = \beta 1 \cdot f1(PC) + \beta 2 \cdot f2(DIF) + \beta 3 \cdot f3(CHG) \quad \text{Eq. (9)}$$

($\beta 1 \cdot \beta 3$ are coefficients satisfying $\beta 1 + \beta 2 + \beta 3 = 1$)

II. Embodiment [2]

FIGS. 14, 15A, and 15B

II.1. Arrangement: FIG. 14

The pitch conversion device 10 according to the embodiment [2] of the present invention shown in FIG. 14 is arranged so as to include, substituting for the degradation evaluating portion 100 in the above-mentioned embodiment [1], a degradation rule database DB in which a combination of all of the voice states and phonemic types estimated as the input signal are associated with the degradation degree DGR to be recorded, and a degradation degree extractor 500 which receives additional information INFO indicating the sound state and the phonemic type of the input signal to extract the degradation degree DGR from the database DB.

The sound state of the additional information INFO indicates a state such as "rise", "fall, "transition", and "steady" estimated as the input signal, and the phonemic type indicates a type such as vowels ("A"-"O") and consonants (except vowels). The relationship between all of the combinations of the voice states and the phonemic types, and the degradation degree DGR (namely, degradation of sound quality which may actually occur) is preliminarily obtained by a simulation, an experiment, or the like to be recorded in the degradation rule database DB.

Hereinafter, the operation of this embodiment will be described. However, since operations except extraction of the degradation degree DGR in the degradation degree extractor 500 is common to that of the above-mentioned embodiment [1], only the operation of the degradation degree extractor 500 will now be described referring to FIGS. 15A and 15B.

II.2. Operation Example: FIGS. 15A and 15B

As shown in FIG. 15A, the degradation degree extractor 500 extracts the degradation degree DGR corresponding to the voice state and the phonemic type indicated by the inputted additional information INFO from the degradation rule database DB shown in FIG. 15B to be provided to the switchover portion 400 (degradation degree extraction T4).

When the voice state and the phonemic type of the additional information INFO respectively indicate the "transition" state and the vowel "O" for example, the degradation degree extractor 500 extracts "10" for the degradation degree DGR from the degradation rule database DB.

III. Embodiment [3]

FIGS. 16-23A, 23B

III.1. Arrangement (Common to Embodiments (8)-(14) of Degradation Evaluating Portion): FIG. 16

The pitch conversion device 10 according to the embodiment [3] of the present invention shown in FIG. 16 is arranged so that the additional information INFO indicating the voice state and the phonemic type of the input signal is inputted to the degradation evaluating portion 100 in addition to the arrangement of the above-mentioned embodiment [1].

III.2. Operation Example: FIGS. 17A, 17B-23A, 23B

While the operation of this embodiment will be described hereinafter, only the embodiments (8)-(14) of the degradation evaluating portion 100 will now be described referring to FIGS. 17A, 17B-23A, 23B since the arrangement and the operation except the calculation of the degradation degree DGR in the degradation evaluating portion 100 are the same as those in the above-mentioned embodiments [1] and [2].

III.3. Embodiments (8)-(14) of Degradation Evaluating Portion: FIGS. 17A, 17B-23A, 23B III.3.A Embodiment (8) of Degradation Evaluating Portion: FIGS. 17A and 17B In addition to the average pitch conversion amount calculator 110, the degradation degree extractor 500, and the degradation rule database DB which are the same as those of the above-mentioned embodiments [1] and [2], the degradation evaluating portion 100 shown in FIG. 17A is provided with the degradation degree calculator 120 which calculates the degradation degree DGR based on the average pitch conversion amount PC and the degradation degree DGR respectively provided from the calculator 110 and the extractor 500.

In operation, as show in FIG. 17B, the average pitch conversion amount calculator 110 and the degradation degree extractor 500 respectively execute the above-mentioned average pitch conversion amount calculation and degradation degree extraction to calculate the average pitch conversion amount PC and to extract the degradation degree DGR (at steps T1 and T4).

The degradation degree calculator 120 calculates the degradation degree DGR by the following Eq. (10) based on the average pitch conversion amount PC and the degradation degree DGR to be provided to the switchover portion 400 (at step S80).

$$\text{degradation degree } DGR = f8(PC, DGR) = \alpha 4 \cdot f1(PC) + (1 - \alpha 4) \cdot DGR \quad \text{Eq. (10)}$$

The coefficient α4 in the above-mentioned function f8 may be preset by an operator or the like so that the switchover between the pitch converters 310 and 320 depending on the degradation degree DGR is optimally performed in the same way as the above-mentioned embodiment [1]. The same applies to coefficients in functions used for embodiments of the degradation evaluating portion as will be described later.

III.3.B Embodiment (9) of Degradation Evaluating Portion: FIGS. 18A and 18B In addition to the average signal difference calculator 130, the degradation degree extractor 500, and the degradation rule database DB which are the same as those of the above-mentioned embodiments [1] and [2], the degradation evaluating portion 100 shown in FIG. 18A is provided with the degradation degree calculator 120 which calculates the degradation degree DGR based on the average signal difference DIF and the degradation degree DGR respectively outputted from the calculator 130 and the extractor 500.

In operation, as show in FIG. 18B, the average signal difference calculator 130 and the degradation degree extractor 500 respectively execute the above-mentioned average signal difference calculation and degradation degree extraction to calculate the average signal difference DIF and to extract the degradation degree DGR (at steps T2 and T4), respectively.

The degradation degree calculator 120 calculates the degradation degree DGR by the following Eq. (11) based on the average signal difference DIF and the degradation degree DGR to be provided to the switchover portion 400 (at step S90).

$$\text{degradation degree } DGR = f9(PC, DGR) = \alpha 5 \cdot f2(DIF) + (1 - \alpha 5) \cdot DGR \quad \text{Eq. (11)}$$

(α5 is coefficient)

III.3.C Embodiment (10) of Degradation Evaluating Portion: FIGS. 19A and 19B In addition to the pitch pattern change degree calculator 140, the pitch pattern change degree calculating table TBL, the degradation degree extractor 500, and the degradation rule database DB which are the same as those in the above-mentioned embodiments [1] and [2], the degradation evaluating portion 100 shown in FIG. 19A is provided with the degradation degree calculator 120 which calculates the degradation degree DGR based on the pitch pattern change degree CHG and the degradation degree DGR respectively provided from the calculator 150 and the extractor 500.

In operation, as shown in FIG. 19B, the pitch pattern change degree calculator 140 and the degradation degree extractor 500 respectively execute the above-mentioned pitch pattern change degree calculation and degradation degree extraction to calculate the pitch pattern change degree CHG and to extract the degradation degree DGR (at steps T3 and T4), respectively.

The degradation degree calculator 120 calculates the degradation degree DGR by the following Eq. (12) based on the pitch pattern change degree CHG and the degradation degree DGR to be provided to the switchover portion 400 (at step S100).

$$\text{degradation degree } DGR = f10(CHG, DGR) = \alpha 6 \cdot f3(CHG) + (1 - \alpha 6) \cdot DGR \quad \text{Eq. (12)}$$

(α 6 is coefficient)

III.3.D Embodiment (11) of Degradation Evaluating Portion: FIGS. 20A and 20B In addition to the above-mentioned embodiment (8) of the degradation evaluating portion, the degradation evaluating portion 100 shown in FIG. 20A is provided with the average signal difference calculator 130 which is the same as that of the above-mentioned embodiment [1].

In operation, as shown in FIG. 20B, the average pitch conversion amount calculator 110, the average signal difference calculator 130, and the degradation degree extractor 500 respectively execute the above-mentioned average pitch conversion amount calculation, average signal difference calculation, and degradation degree extraction to calculate the average pitch conversion amount PC and the average signal difference DIF and to extract the degradation degree DGR (at steps T1, T2, and T4), respectively.

The degradation degree calculator 120 calculates the degradation degree DGR by the following Eq. (13) based on the average pitch conversion amount PC, the average signal difference DIF, and the degradation degree DGR to be provided to the switchover portion 400 (at step S110).

$$\text{degradation degree } DGR = f11(PC, DIF, DGR) = \gamma 1 \cdot f1(PC) + \gamma 2 \cdot f2(DIF) + \gamma 3 \cdot DGR \quad \text{Eq. (13)}$$

($\gamma 1$-$\gamma 3$ are coefficients satisfying $\gamma 1 + \gamma 2 + \gamma 3 = 1$)

III.3.E Embodiment (12) of Degradation Evaluating Portion: FIGS. 21A and 21B In addition to the above-mentioned embodiment (8) of the degradation evaluating portion, the degradation evaluating portion 100 shown in FIG. 21A is provided with the pitch pattern change degree calculator 140 and the pitch pattern change degree calculating table TBL which are the same as those of the above-mentioned embodiment [1].

In operation, as show in FIG. 21B, the average pitch conversion amount calculator 110, the pitch pattern change degree calculator 140, and the degradation degree extractor 500 respectively execute the above-mentioned average pitch conversion amount calculation, pitch pattern change degree calculation, and degradation degree extraction to calculate the average pitch conversion amount PC and the pitch pattern change degree CHG and to extract the degradation degree DGR (at steps T1, T3, and T4), respectively.

The degradation degree calculator 120 calculates the degradation degree DGR by the following Eq. (14) based on the average pitch conversion amount PC, the pitch pattern change degree CHG, and the degradation degree DGR to be provided to the switchover portion 400 (at step S120).

$$\text{degradation degree } DGR = f12(PC, CHG, DGR) = \delta 1 \cdot f1(PC) + \delta 2 \cdot f3(CHG) + \delta 3 \cdot DGR \quad \text{Eq. (14)}$$

($\delta 1$-$\delta 3$ are coefficients satisfying $\delta 1 + \delta 2 + \delta 3 = 1$)

III.3.F Embodiment (13) of Degradation Evaluating Portion: FIGS. 22A and 22B In addition to the above-mentioned embodiment (9) of the degradation evaluating portion, the degradation evaluating portion 100 shown in FIG. 22A is provided with the pitch pattern change degree calculator 140 and the pitch pattern change degree calculating table TBL which are the same as those of the above-mentioned embodiment [1].

In operation, as shown in FIG. 22B, the average signal difference calculator 130, the pitch pattern change degree calculator 140, and the degradation degree extractor 500 respectively execute the above-mentioned average signal difference calculation, pitch pattern change degree calculation, and degradation degree extraction to calculate the average signal difference DIF and the pitch pattern change degree CHG and to extract the degradation degree DGR (at steps T2-T4), respectively.

The degradation degree calculator 120 calculates the degradation degree DGR by the following Eq. (15) based on the average signal difference DIF, the pitch pattern change degree CHG, and the degradation degree DGR to be provided to the switchover portion 400 (at step S130).

$$\text{degradation degree } DGR = f13(DIF, CHG, DGR) = \varepsilon 1 \cdot f2(DIF) + \varepsilon 2 \cdot f3(CHG) + \varepsilon 3 \cdot DGR \quad \text{Eq. (15)}$$

($\varepsilon 1$-$\varepsilon 3$ are coefficients satisfying $\varepsilon 1 + \varepsilon 2 + \varepsilon 3 = 1$)

III.3.G Embodiment (14) of Degradation Evaluating Portion: FIGS. 23A and 23B In addition to the above-mentioned embodiment (11) of the degradation evaluating portion, the degradation evaluating portion 100 shown in FIG. 23A is provided with the pitch pattern change degree calculator 140 and the pitch pattern change degree calculating table TBL which are the same as the above-mentioned embodiment [1].

In operation, as shown in FIG. 23B, the average pitch conversion amount calculator 110, the average signal difference calculator 130, the pitch pattern change degree calculator 140, and the degradation degree extractor 500 respectively execute the above-mentioned average pitch conversion amount calculation, average signal difference calculation, pitch pattern change degree calculation, and degradation degree extraction to calculate the average pitch conversion amount PC, the average signal difference DIF, and the pitch pattern change degree CHG and to extract the degradation degree DGR (at steps T1-T4), respectively.

The degradation degree calculator 120 calculates the degradation degree DGR by the following Eq. (16) based on the average pitch conversion amount PC, the average signal difference DIF, the pitch pattern change degree CHG, and the degradation degree DGR to be provided to the switchover portion 400 (at step S140).

$$\text{degradation degree } DGR = f14(PC, DIF, CHG, DGR) = \zeta 1 \cdot f1(PC) + \zeta 2 \cdot f2(DIF) + \zeta 3 \cdot f3(CHG) + \zeta 4 \cdot DGR \quad \text{Eq. (16)}$$

($\zeta 1$-$\zeta 4$ are coefficients satisfying $\zeta 1 + \zeta 2 + \zeta 3 + \zeta 4 = 1$)

It is to be noted that the present invention is not limited by the above-mentioned embodiments, and it is obvious that various modifications may be made by one skilled in the art based on the recitation of the claims.

What is claimed is:

1. A pitch conversion method, comprising:

executing a degradation evaluation of inputting an input signal pitch pattern data per predetermined processing data unit and a target pitch pattern data for the input signal pitch pattern data, and calculating a degradation degree indicating how a waveform of the input signal data degrades upon a pitch conversion from the input signal pitch pattern data to the target pitch pattern data; and performing the pitch conversion, via a pitch converter, with a predetermined pitch converting data throughput depending on the degradation degree calculated.

2. The pitch conversion method as claimed in claim 1, wherein the degradation evaluation includes calculating an average pitch conversion amount by dividing a sum of pitch differences between the target pitch pattern data and the input signal pitch pattern data per a predetermined cycle by a sum of pitches of the input signal pitch pattern data per the predetermined cycle, and providing as the degradation degree for the pitch conversion a value that is the average pitch conversion amount weighted by predetermined coefficients.

3. The pitch conversion method as claimed in claim 1, wherein the pitch conversion includes a first and second pitch conversions depending on a level of the degradation degree, the degradation evaluation includes identical first and second pitch conversions, the degradation evaluation includes an average signal difference calculation of calculating an average signal difference by dividing a sum of power differences between a first pitch conversion result obtained by converting a part of the input signal pitch pattern data per predetermined processing data unit and the target pitch pattern data at the first pitch conversion and a second pitch conversion result obtained by converting another part of the input signal pitch pattern data per predetermined processing data unit and the target pitch pattern data at the second pitch conversion per a predetermined cycle by a sum of powers of the second pitch conversion result per the predetermined cycle, and providing as the degradation degree for the pitch conversion a value that is the average signal difference weighted by predetermined coefficients.

4. The pitch conversion method as claimed in claim 1, wherein the degradation evaluation includes a pitch pattern change degree calculation of classifying changing trends of the input signal pitch pattern data and the target pitch pattern data respectively into any one of predetermined changing trends by calculating average pitches per a predetermined time interval of the pitch pattern and by sequentially comparing the average pitches, and a pitch pattern change degree is determined relative to the target pitch pattern data for the input signal pitch pattern data based on a combination of both changing trends, and providing as the degradation degree for the pitch conversion a value that is the pitch pattern change degree weighted by predetermined coefficients.

5. The pitch conversion method as claimed in claim 2, wherein the pitch conversion includes a first and second pitch conversions depending on a level of the degradation degree, the degradation evaluation also includes identical first and second pitch conversions, the degradation evaluation includes an average signal difference calculation of calculating an average signal difference by dividing a sum of power differences between a first pitch conversion result obtained by converting a part of the input signal pitch pattern data per predetermined processing data unit and the target pitch pattern data at the first pitch conversion and a second pitch conversion result obtained by converting another part of the input signal pitch pattern data per predetermined processing data unit and the target pitch pattern data at the second pitch conversion per a predetermined cycle by a sum of powers of the second pitch conversion result per the predetermined cycle, and providing as the degradation degree for the pitch conversion a sum of values that are the average pitch conversion amount and the average signal difference respectively weighted by predetermined coefficients.

6. The pitch conversion method as claimed in claim 2, wherein the degradation evaluation includes a pitch pattern change degree calculation of classifying changing trends of the input signal pitch pattern data and the target pitch pattern data respectively into any one of predetermined changing trends by calculating average pitches per a predetermined time interval of the pitch pattern and by sequentially comparing the average pitches, and of determining a pitch pattern change degree to the target pitch pattern data for the input signal pitch pattern data based on a combination of both changing trends, and providing as the degradation degree for the pitch conversion a sum of values that are the average pitch conversion amount and the pitch pattern change degree respectively weighted by predetermined coefficients.

7. The pitch conversion method as claimed in claim 3, wherein the degradation evaluation includes a pitch pattern change degree calculation of classifying changing trends of the input signal pitch pattern data and the target pitch pattern data respectively into any one of predetermined changing trends by calculating average pitches per a predetermined time interval of the pitch pattern and by sequentially comparing the average pitches, and of determining a pitch pattern change degree to the target pitch pattern data for the input signal pitch pattern data based on a combination of both changing trends, and providing as the degradation degree for the pitch conversion a sum of values that are the average signal difference and the pitch pattern change degree respectively weighted by predetermined coefficients.

8. The pitch conversion method as claimed in claim 5, wherein the degradation evaluation includes a pitch pattern change degree calculation of classifying changing trends of the input signal pitch pattern data and the target pitch pattern data respectively into any one of predetermined changing trends by calculating average pitches per a predetermined time interval of the pitch pattern and by sequentially comparing the average pitches, and of determining a pitch pattern change degree to the target pitch pattern data for the input signal pitch pattern data based on a combination of both changing trends, and providing as the degradation degree for the pitch conversion a sum of values that are the average pitch conversion amount, the average signal difference, and the pitch pattern change degree respectively weighted by predetermined coefficients.

9. A pitch conversion device comprising:

a degradation evaluator inputting an input signal pitch pattern data per predetermined processing data unit and a target pitch pattern data for the input signal pitch pattern data, and calculating a degradation degree indicating how a waveform of the input signal degrades upon a pitch conversion from the input signal pitch pattern data to the target pitch pattern data; and a pitch converter performing the pitch conversion with a predetermined pitch converting data throughput depending on the degradation degree calculated.

10. The pitch conversion device as claimed in claim 9, wherein the degradation evaluator includes an average pitch conversion amount calculator calculating an average pitch conversion amount by dividing a sum of pitch differences between the target pitch pattern data and the input signal pitch pattern data per a predetermined cycle by a sum of pitches of the input signal pitch pattern data per the predetermined cycle, and a degradation degree calculator providing as the degradation degree to the pitch converter a value that is the average pitch conversion amount weighted by predetermined coefficients.

11. The pitch conversion device as claimed in claim 9, wherein the pitch converter includes a first and second pitch converters depending on a level of the degradation degree, the degradation evaluator also includes the identical first and second pitch converters, the degradation evaluator includes an average signal difference calculation calculator calculating an average signal difference by dividing a sum of power differences between a first pitch conversion result obtained by converting a part of the input signal pitch pattern data per predetermined processing data unit and the target pitch pattern data at the first pitch converter and a second pitch conversion result obtained by converting another part of the input signal pitch pattern data per predetermined processing data unit and the target pitch pattern data at the second pitch converter per a predetermined cycle by a sum of powers of the second pitch conversion result per the predetermined cycle, and a degradation degree calculator providing as the degradation degree to the pitch converter a value that is the average signal difference weighted by predetermined coefficients.

12. The pitch conversion device as claimed in claim 9, wherein the degradation evaluator includes a pitch pattern change degree calculator classifying changing trends of the input signal pitch pattern data and the target pitch pattern data respectively into any one of predetermined changing trends by calculating average pitches per a predetermined time interval of the pitch pattern and by sequentially comparing the average pitches, and determining a pitch pattern change degree to the target pitch pattern data for the input signal pitch pattern data based on a combination of both changing trends, and the degradation degree calculator providing as the degradation degree to the pitch converter a value that is the pitch pattern change degree weighted by predetermined coefficients.

13. The pitch conversion device as claimed in claim 10, wherein the pitch converter includes a first and second pitch converters depending on a level of the degradation degree, the degradation evaluator also includes identical first and second pitch converters, the degradation evaluator includes an average signal difference calculator calculating an average signal difference by dividing a sum of power differences between a first pitch conversion result obtained by converting a part of the input signal pitch pattern data per predetermined processing data unit and the target pitch pattern data at the first pitch converter and a second pitch conversion result obtained by converting another part of the input signal pitch pattern data per predetermined processing data unit and the target pitch pattern data at the second pitch converter per a predetermined cycle by a sum of powers of the second pitch conversion result per the predetermined cycle, and the degradation degree calculator provides as the degradation degree to the pitch converter a sum of values that are the average pitch conversion amount and the average signal difference respectively weighted by predetermined coefficients.

14. The pitch conversion device as claimed in claim 10, wherein the degradation evaluator includes a pitch pattern change degree calculator classifying changing trends of the input signal pitch pattern data and the target pitch pattern data respectively into any one of predetermined changing trends by calculating average pitches per a predetermined time interval of the pitch pattern and by sequentially comparing the average pitches, and determining a pitch pattern change degree to the target pitch pattern data for the input signal pitch pattern data based on a combination of both changing trends, and the degradation degree calculator provides as the degradation degree to the pitch converter a sum of values that are the average pitch conversion amount and the pitch pattern change degree respectively weighted by predetermined coefficients.

15. The pitch conversion device as claimed in claim 11, wherein the degradation evaluator includes a pitch pattern change degree calculator classifying changing trends of the input signal pitch pattern data and the target pitch pattern data respectively into any one of predetermined changing trends by calculating average pitches per a predetermined time interval of the pitch pattern and by sequentially comparing the average pitches, and determining a pitch pattern change degree to the target pitch pattern data for the input signal pitch pattern data based on a combination of both changing trends, and the degradation degree calculator provides as the degradation degree to the pitch converter a sum of values that are the average signal difference and the pitch pattern change degree respectively weighted by predetermined coefficients.

16. The pitch conversion device as claimed in claim 13, wherein the degradation evaluator includes a pitch pattern change degree calculator classifying changing trends of the input signal pitch pattern data and the target pitch pattern data respectively into any one of predetermined changing trends by calculating average pitches per a predetermined time interval of the pitch pattern and by sequentially comparing the average pitches, and determining a pitch pattern change degree to the target pitch pattern data for the input signal pitch pattern data based on a combination of both changing trends, and the degradation degree calculator provides as the degradation degree to the pitch converter a sum of values that are the average pitch conversion amount, the average signal difference, and the pitch pattern change degree respectively weighted by predetermined coefficients.

* * * * *